US006332755B1

(12) United States Patent
Fujinaka et al.

(10) Patent No.: US 6,332,755 B1
(45) Date of Patent: Dec. 25, 2001

(54) BLOWER AND METHOD FOR MOLDING HOUSING THEREOF

(75) Inventors: Hiroyasu Fujinaka; Shigeru Otsuka, both of Yonago (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/627,004

(22) Filed: Jul. 27, 2000

Related U.S. Application Data

(62) Division of application No. 09/090,944, filed on Jun. 5, 1998, now Pat. No. 6,132,171.

(30) Foreign Application Priority Data

Jun. 10, 1997 (JP) ..... 9-151450
Sep. 26, 1997 (JP) ..... 9-260738
Nov. 28, 1997 (JP) ..... 9-326843

(51) Int. Cl.[7] ..... F04D 29/66

(52) U.S. Cl. ..... 415/208.5; 415/119; 415/211.1; 415/214.1; 415/914

(58) Field of Search ..... 415/119, 186, 415/187, 208.3, 208.5, 209.1, 211.1, 214.1, 220, 222, 223, 914; 416/247 R

(56) References Cited

U.S. PATENT DOCUMENTS 4,895,489 * 1/1990 Kohama et al. ..... 415/222
6,179,562 * 1/2001 Fujinaka ..... 415/208.5
6,183,196 * 2/2001 Fujinaka ..... 415/208.5

* cited by examiner

*Primary Examiner*—Christopher Verdier
(74) *Attorney, Agent, or Firm*—Parkhurst & Wendel, L.L.P.

(57) ABSTRACT

The present invention provides a blower that improves the P-Q characteristic and reduces noise. The apparatus is a blower that sucks air inside through slits (6) provided in an annular wall (2), wherein the blade thickness near a blade end s is progressively reduced toward the front end, and the location F of the maximum thickness gradually moves back toward a blade trailing edge side u2 so as to make the blade advance angle near the front end larger than in other locations. In addition, the width of a slit is made wider in sections near a spacer than in other sections. Alternatively, notches are provided in the outer perimeter of annular plates near the spacers so as to reduce the radial length of the annular plates. This arrangement improves the P-Q characteristic and reduces noise.

7 Claims, 31 Drawing Sheets section on l-l' section on m-m' section on n-n'

PRIOR ART section on $l_1 - l_1'$ section on $l_2 - l_2'$ section on $l_3 - l_3'$ section on m-m' section on n-n'

BLOWER AND METHOD FOR MOLDING HOUSING THEREOF

This is a Rule 1.53(b) Division of application Ser. No. 09/090,944 filed Jun. 5, 1998, now U.S. Pat. No. 6,132,171.

FIELD OF THE INVENTION

The present invention relates to a blower.

BACKGROUND OF THE INVENTION

Reducing equipment in size using electronic devices has prompted the use of high-density electrical circuits. Since the density of heat produced by electronic equipment increases with increasing density of electronic devices in it, axial-flow blowers or oblique-flow blowers are used to cool electronic equipment.

As shown in FIG. 11, in a conventional blower, an annular wall 2 is formed away from the end of a blade of an axial-flow fan 1, which rotates about a shaft 4, thus causing an air flow 5 from the suction side to the discharge side when a motor 3 is energized, that is, the blower is in operation.

When the blower is in operation, however, the velocity of the air flow increases on the back pressure side at the blade end, so that under the influence of secondary flows between blades, a low-energy region occurs on the blade trailing edge side, where the velocity is converted to pressure energy.

In the low-energy region, energy loss is significant and air flow easily separates from blade surfaces, over which vortices occur, thus increasing turbulent flow noise. Thus the region poses a problem of an increase in noise level and a deterioration in static pressure-flow rate characteristic (hereinafter referred to as the P-Q characteristic).

The phenomenon mentioned above is frequently observed, especially when a fan exhibits stall conditions because large leakage vortices occur at the end of a blade under the action of flow resistance (system impedance) on the discharge side.

U.S. Pat. No. 5,707,205, previously obtained by the applicant of the present invention, discloses that by sucking laminar air flow inside an annular wall through a slit therein when a blower is in operation, a blower inhibits leakage vortices and rotation stall from occurring at the end of a blade to improve the P-Q characteristic and reduce noise.

PCT-based Japanese Patent Laid-Open No. 6-508319 and U.S. Pat. No. 5,292,088 disclose that a blower is arranged so that vortices of air flowing through a plurality of rings, spaced apart from each other around an axial-flow fan, increase the air flow rate.

U.S. Pat. No. 5,407,324 discloses that a blower is arranged to make it possible for air to flow inside and outside a housing by inclining to the direction of air flow the internal perimeter of a plurality of annular plates, stacked around an axial-flow fan.

However, common blowers for personal computers and workstations, which are made rectangular with standardized dimensions to reduce their costs, have external dimensions of 60 mm square to 92 mm square. Thus it is not desired that a blower be significantly changed into a round shape by, for example, making annular plates $\mathbf{7}_1$ to $\mathbf{7}_5$, forming the annular wall 2, circular as shown in FIG. 12.

U.S. Pat. No. 5,707,205 also discloses a blower whose annular wall 2 is shaped so that its sections corresponding to the middle of the upper, lower, right, and left sides of a rectangular casing body 15 are flush with the casing body 15 as shown in FIGS. 13*a* and 13*b*. However, only making the contour of the annular wall rectangular as shown in FIGS. 13*a* and 13*b* causes the effect of sucking laminar air flow inside the annular wall through each slit 6 to be slightly lessened, compared with an annular wall which has a round contour as shown in FIG. 12. Thus the effect of improving the P-Q characteristic and reducing noise cannot fully be provided. The casing body described by U.S. Pat. No. 5,707,205 also has a problem of low mechanical strength and the like, because the sides of the annular wall are thinner than the other sections.

Every blower mentioned above improves a fan characteristic by sucking air around a fan. The applications only describe the arrangement of rings (annular plates) around a fan, not the shape of the fan. To fully exhibit the characteristic of a fan, its shape must be devised.

A method has generally been used which predicts the performance of a fan or determines the three-dimensional shape of a fan appropriate for use conditions by cutting a fan blade through the surfaces of cylinders concentric with the axis of rotation of the fan, developing the surfaces, converting a fan blade into a plane infinite straight-line series, and applying to the series a straight-line airfoil system theory suggested for aircraft and the like.

However, a problem with the method is that the actual performance of a fan becomes lower than that predicted by calculations under the influence of leakage vortices at the ends of blades when flow resistance higher than a given level acts on the blower.

To solve this problem by modifying the shape of the end of a blade, some fans, including one disclosed in Japanese Patent Application Laid-Open No. 6-307396, are arranged so that aerodynamic performance is improved and noise is reduced by positioning the cross-sectional section at the end of an outer blade of the fan on the leading edge side and providing an upwardly curved one-sided curved section and an arcuate section following the one-sided curved section only on the pressure surface side.

Some blowers, including one disclosed in Japanese Patent Application Laid-Open No. 8-121391, are arranged so that aerodynamic noise is reduced by curving the periphery of a blade.

Some hydraulic apparatuses, including one disclosed in Japanese Patent Application Laid-Open No. 8-284884, are arranged so that by cutting the back side of the end of a moving blade a given height from the tip and forming a thin-walled section of a constant thickness on the back side, fluid leakage from a tip clearance is reduced, thus improving the efficiency of an axial-flow blower.

However, if the above-described fan shapes according to prior art, which assumes that no air flows in from outside an annular wall, are applied to an arrangement where air is sucked from outside an annular wall, no satisfactory performance is exhibited.

Although U.S. Pat. No. 5,407,324 discloses an arrangement of the rings, the arrangement is not acceptable in terms of mass productivity, strength, and accuracy.

It is an object of the present invention to provide a blower which exhibits an improved P-Q characteristic and reduces noise as a blower in FIG. 12 whose annular wall has a circular contour even when substituted for a conventional rectangular blower and which has practically necessary strength.

It is another object of the present invention to optimize the shape of a fan blade and that of an annular wall of a blower which sucks air inside the wall through slits provided therein to improve aerodynamic performance and strength and reduce cost by increasing mass productivity.

DISCLOSURE OF THE INVENTION

First of all, an annular wall of a blower according to the present invention is described which is contoured in a non-circular shape including a rectangular shape. The present invention provides a blower characterized in that an annular wall is formed away from the ends of fan blades, and slits passing from the circular inner perimeter to the non-circular outer perimeter of the annular wall are provided in sections of the wall which are opposite to the ends of fan blades, whereby the flow rate of air flowing inside the annular wall through the slits is constant around the annular wall, although the distance between the inner perimeter and the outer perimeter varies with locations in the annular wall.

The blower is also characterized in that the flow rate of air flowing inside the annular wall through the slits is made constant all around the annular wall by continuously changing the width of the slits, w, according to the radial length between the inner perimeter and the outer perimeter of the annular wall, L, so that the condition represented by the following equation or its close condition is met:

$$w^3/L=\text{constant}.$$

The blower is also characterized in that the flow rate of air flowing inside the annular wall through the slits is made constant all around the annular wall by changing the width of the slits, w, and the number of slits in the direction of the axis of rotation, n (n is a positive integer), according to L, so that the condition represented by the following equation or its close condition is met:

$$n \cdot w^3/L=\text{constant}.$$

Specifically, the annular wall with the slits is arranged by stacking a plurality of annular plates in the direction of the axis of rotation of a fan, the annular plates being separated from each other.

More specifically, the present invention provides a blower which sucks air inside an annular wall through slits as a fan rotates, the annular wall being formed away from the ends of fan blades, the outer peripheral sections of the annular wall which correspond to the ends of fan blades being formed to be planar and substantially flush with a rectangular casing body at the middle of upper, lower, right, and left sides of the body, and slits, passing from the circular inner perimeter to the non-circular outer perimeter of the annular wall, being provided in sections of the wall which are opposite to the ends of fan blades, characterized in that the equation $n \cdot w^3/L=\text{constant}$ is met, where the width of the slits is w, the number of slits in the direction of the axis of rotation is n (n is a positive integer) and the distance in the radial direction between the inner perimeter to the outer perimeter of the annular wall is L, or alternatively the width of the slits, w, and the number of slits in the direction of the axis of rotation n, are changed according to L so as to satisfy the close condition of said equation.

This arrangement enables the flow rate of air flowing inside the annular wall through the slits to be constant all around the annular wall even when a conventional blower with a rectangular contour is replaced with a blower of the present invention. Thus the P-Q characteristic is improved, and noise is reduced as is the case with a blower with a circular contour, shown in FIG. 12.

By disposing spacers forming and supporting the slits at or near the middle of the four sides of the casing body, the annular plates can be supported as well as weak sections of the annular plates can be reinforced.

Projecting toward the outer perimeter of the annular wall the spacers in the middle of the four sides of the casing body prevents the annular plates from being damaged or deforming under an undue load when a blower is installed.

Tapering the projected sections of the spacers along the axis of rotation increases the workability at the time of installing the blower.

Next, the shape of a blade of a blower fan according to the present invention is described. The present invention provides a blower that sucks air inside the annular wall also through the slits provided therein, wherein the shape of fan blades is improved and in this connection the shape of the housing is further improved.

The present invention improves aerodynamic performance, strength, and mass productivity, thus realizing cost savings.

According to a first aspect of the present invention, which aspect relates to a fan blade shape, a blower that is arranged so that air is sucked inside the annular wall through the slits provided therein is characterized in that a cross-sectional shape obtained by cutting a blade of a fan through the surface of a cylinder concentric with the axis of rotation of the fan is an airfoil and that the shape of the blade near the end thereof is formed to be an airfoil with respect to air flowing in through the slits. The blower is also arranged so that a blade at a section near its end becomes progressively thinner towards the end, and the location which provides the maximum thickness of the airfoil obtained by cutting the fan through the surface of a cylinder concentric with the axis of rotation gradually moves back toward the blade trailing edge side according as the location approaches the end of the blade. The blade advance angle θ is made larger near the end of a blade than in other locations, which angle is set to meet the following equation, $$\theta=\tan^{-1}(v/u)$$

where v is the average velocity of air flowing in from outside the annular wall, and u is the peripheral speed of a blade end. The blade advance angle near the end of a blade is set equal to the angle of a slit in the annular wall. The first aspect improves the P-Q characteristic and noise reduction performance.

According to a second aspect of the present invention, which aspect relates to the annular wall associated with a fan, a plurality of annular plates are stacked through spacers in the direction of the axis of rotation, the annular plates being separated from each other, to form the annular wall with slits, and one of the plurality of annular plates which is at the most upstream side of a main air flow produced by the fan is made thicker than the remaining annular plates. This arrangement significantly improves both the P-Q characteristic and the strength of the fan at a high level. In addition, by cutting the upstream-side end surface of the inner periphery of the annular plate on the most upstream side of the main air flow, the periphery becomes thinner, thereby improving blower performance.

According to a third aspect of the present invention, the clearance between the end of a blade and the inner perimeter of the annular wall is wider as it gets farther away from a bearing support. This arrangement has the effect of preventing the dimensions from changing with time and the end of the fan blade from touching the inner perimeter of the annular wall due to initial dimensional variations.

According to a fourth aspect of the present invention, a plurality of annular plates are stacked in a spaced relation from each other through spacers in the direction of the axis of rotation to form an annular wall with slits, and the width of the slits is larger only near the spacers than in other locations. This arrangement cancels the effect of the spacers and improves the P-Q characteristic of a blower. Alternatively, the width of the slits near the spacers is made equal to or smaller than in other locations, thus fully improving the P-Q characteristic and reducing noise.

According to a fifth aspect of the present invention, notches are provided near the spacers in the outer perimeter of the annular plates so as to reduce the radial length of the annular plates. This arrangement cancels the effect of the spacers and improves the P-Q characteristic of the blower.

According to a sixth aspect of the present embodiment, the number of spacers used to stack the annular plates is set at n (n is an integer equal to or larger than five), and at least (n-2) of the n spacers are disposed in parallel with each other. This arrangement increases the housing mass productivity, thereby contributing to cost savings. Further, inclining the spacers near four sides of a casing body with respect to the radial direction increases mass productivity and reduces cost while minimizing a deterioration in blower performance. Inclining the spacers in four corners of a casing body with respect to the radial direction is expected to exercise the same effect.

Chamfering or obliquely cutting the outer peripheral ends of the spacers inclined with respect to the radial direction improves blower performance.

According to the final aspect of the present invention, a blower housing molding method for molding a housing of the blower is provided which employs a pair of upper and lower molds for forming the inner surface of the annular wall and a boss, and a pair of slide cores sliding opposite to each other at right angles to the moving direction of the pair of molds, wherein the slits are formed all around the annular wall by said pair of slide cores at a time, and the annular wall with the slits, a base serving as a reference for installing the blower and the boss to which a motor is secured are molded respectively as a single piece. This method can increase mass productivity and reduce noise.

DETAILED DESCRIPTION

Figure 1A:
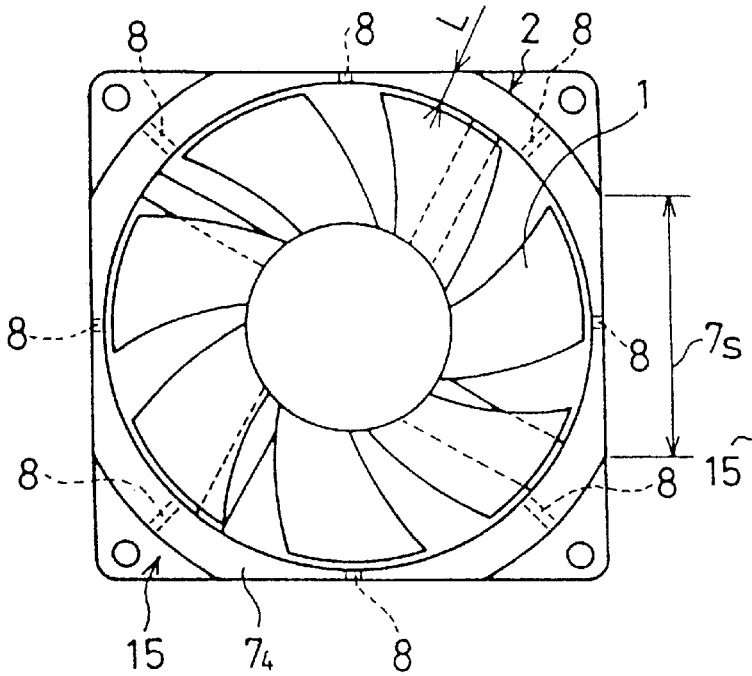
FIGS. 1*a* through 1*c* are a front view, a side view, and a cross-sectional view of an axial-flow blower of a first embodiment of the present invention, respectively.

Referring now to the drawings, the embodiments of the present invention are described below.

FIGS. 1*a* through 1*c* and FIGS. 2 through 4 illustrate the first embodiment of the present invention. A blower in FIGS. 1*a* through 1*c* has annular plates $\mathbf{7}_1$ through $\mathbf{7}_4$ attached to a casing body 15, which form an annular wall 2 surrounding an axial-flow fan 1. The annular plates $\mathbf{7}_1$ through $\mathbf{7}_4$ are stacked with spacers 8 in between to form a slit 6 between any two annular plates next to each other.

Figure 1B:
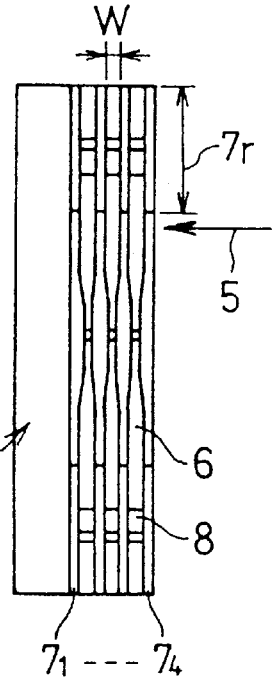
Figure 1C:
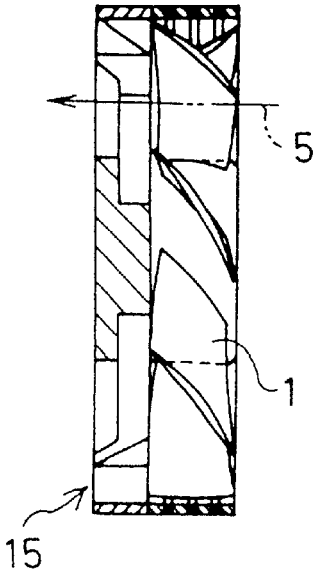

As shown in FIG. 1*c*, the width of the stack of the annular plates $7_1$ through $7_4$, including the slits 6, is set equal to or substantially equal to that of the axial-flow fan 1 in the direction of the axis thereof. The width of a slit 6, w, is continuously changed so that flow resistance is equal at every location around the axial-flow fan 1.

Specifically, the width of a slit 6, w, which is not constant around the axial-flow fan 1, is arranged as described below.

Figure 2:
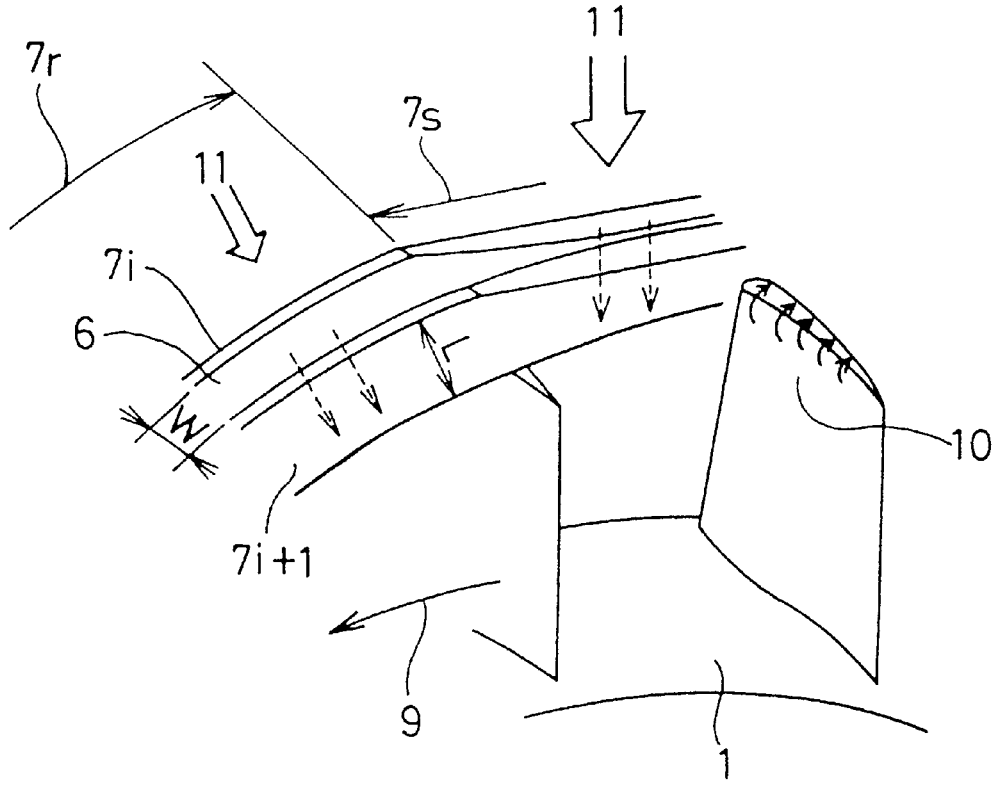
FIG. 2 is a diagram illustrating the operating principle of the first embodiment.
Figure 3:
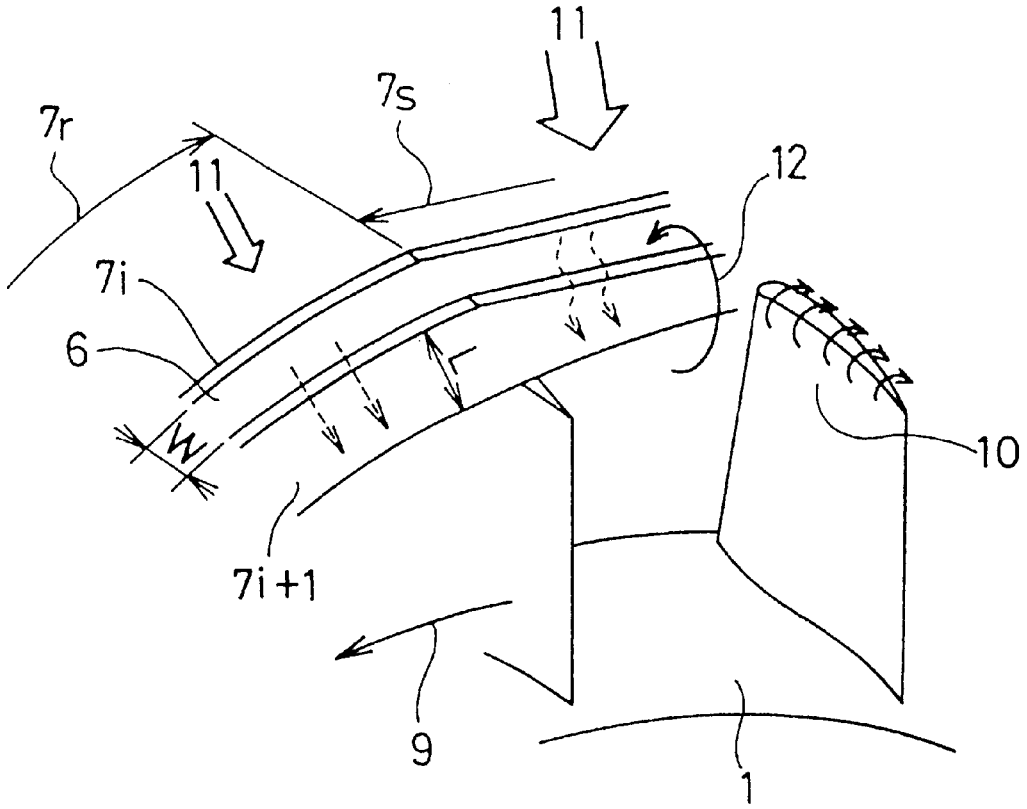
FIG. 3 is a diagram illustrating the operating principle.

FIG. 2 schematically illustrates a slit 6 in a blower of the present invention whose width w changes, and FIG. 3 schematically shows a slit 6 whose width w is constant around a fan.

As shown in FIG. 3, when the width of the slit 6, w, is constant around the fan, this axial-flow fan 1 is driven to rotate in the direction indicated by an arrow 9, thus causing negative pressure on the back pressure side at a blade end, so that an air flow 11 goes inwardly through each slit 6 due to the pressure difference across the slit. Setting the width of a slit 6, w, to an appropriate value makes the air flow 11, going through each slit 6, laminar, so that leakage vortices 10 flowing from the positive pressure side to the back pressure side are inhibited and flow separation on the back pressure surface of a blade is eliminated.

However, if the width w is constant around the fan as shown in FIG. 3, an interval 7*s* of a slit 6 (the radial length of an axial-flow fan 1), in which a section of the perimeter of the annular plates $7_1$ through $7_4$ is straight, is shorter than an interval 7*r* of the slit 6, in which a section of the perimeter of the annular plates $7_1$ through $7_4$ is arcuate, the interval 7*s* of a slit has a smaller flow resistance of air than the interval 7*r* of a slit. This causes the amount of incoming air through the interval 7*s* to be larger than that of incoming air through the interval 7*r*, so that an air flow through the interval 7*r* easily becomes turbulent and that a larger amount of air flows over some portions of the fan; a smaller amount of air flows over others. These phenomena cause the blades to vibrate or disk circulation 12 to easily occur, that is, air, which has come in through a slit, to come out through the next slit, thus leading to a deterioration in the P-Q characteristic and an increase in noise.

On the other hand, according to the present invention, the width of the interval 7*r* of a slit is constant as shown in FIG. 2 while the interval 7*s* of a slit is narrowest in the middle as shown in FIG. 1*b* and progressively becomes wider from the middle to both ends until the width of the interval is equal to that of the interval 7*r* of a slit.

In detail, the width of the interval 7*s* of a slit is continuously changed so that flow resistance is the same at every circumferential location in the axial-flow fan 1.

In this case, the interval 7*s* and the interval 7*r* have the same flow resistance. Thus the amount of incoming air is the same all around the fan, so that blade vibration, disk circulation, and the like are inhibited. This, in turn, means that the P-Q characteristic does not deteriorate and that noise does not increase.

Requirements for equalizing flow resistance in every interval of a slit are described below, using examples.

Figure 4:
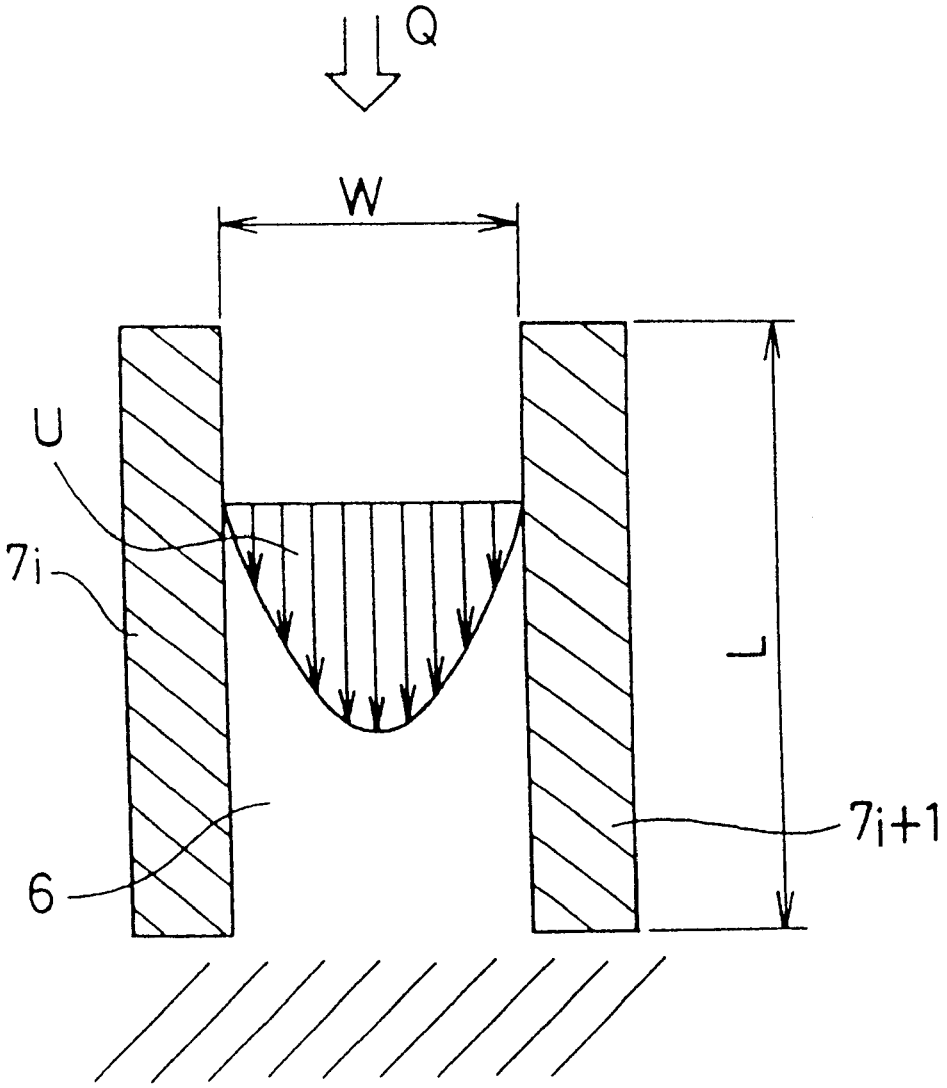
FIG. 4 is a diagram illustrating an air flow through a slit.

FIG. 4 schematically shows the air velocity profile in a slit. Air flow in the slit is assumed to be laminar, and spacer resistance and air compression are neglected.

In FIG. 4, w is the width of a slit, L is the length of the slit, u is air velocity, and Q is the amount of incoming air through the slit per unit time. ΔP, not shown, expresses the pressure difference across the slit, that is, the difference between the atmospheric pressure and the pressure on the fan side. As shown in FIG. 4, the velocity profile in the slit is parabolic. The amount of incoming air through one slit per unit time, Q, is expressed as $$Q=\Delta P\cdot w^3/(12\cdot\eta\cdot L)$$

where η is the viscosity of air. ΔP depends on the rotating speed of the fan. Since η, the viscosity of air, is constant everywhere, a requirement for keeping Q constant is given by $$w^3/L=\text{constant}.$$

The above equation shows that a well performing blower can be provided which inhibits blade vibration, disk circulation, and the like, thus eliminating a deterioration in the P-Q characteristic and an increase in noise, since reducing the value of w according to the above equation makes the amount of incoming air constant all around the fan on the four sides, where L is small.

Figure 5A:
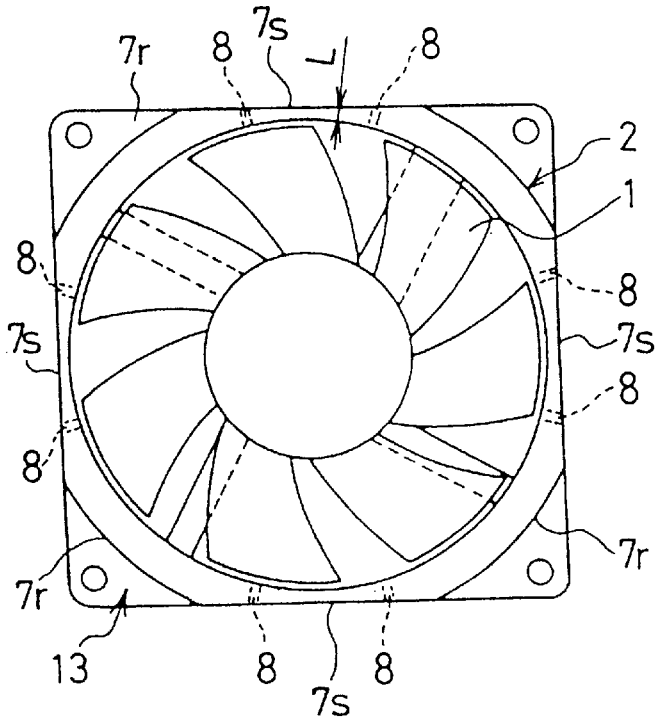
FIGS. 5*a* and 5*b* are a front view and a side view of an axial-flow blower of a second embodiment, respectively.
Figure 5B:
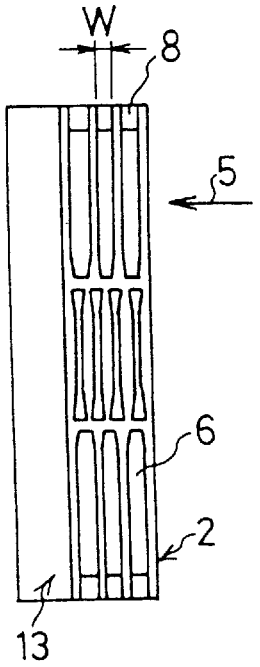

FIGS. 5*a* through 5*b* show the second embodiment. In the first embodiment, the width of a slit, w, is continuously changed to keep flow resistance constant in the intervals 7*s* and 7*r*, with the same number of slits in the intervals 7*s* and 7*r*. In the second embodiment, on the other hand, the width of a slit, w, and the number of slits, n, are changed at the same time to keep flow resistance constant in the intervals.

Although in the first embodiment, air flow in a slit is assumed to be laminar, whether it is laminar or not depends largely on the contour, dimensions, surface roughness, and the like of the slit.

Especially if the air velocity u is high and the dimension in the direction of air flow, L, is small as in the case of the slits on the four sides (intervals 7*s* ) in the first embodiment, air flow through a slit easily becomes turbulent.

The Reynolds number Re, a dimensionless number, on which whether an air flow is laminar or turbulent depends, is written as $$Re=(u\cdot w)/\nu$$

where ν is the kinetic viscosity of air, u is the air velocity, w is the width of a slit. The smaller the Reynolds number Re is, the more easily air flow in a slit becomes laminar.

Specifically, making the width w of a slit one size narrower along its entire circumference can make air flow through the slit laminar.

However, reducing the width w of a slit increases the flow resistance of incoming air, thus slightly lessening the effect of improving the P-Q characteristic and reducing noise.

The second embodiment in FIGS. 5*a* and 5*b* is an improvement over the first embodiment, which has been made so that the amount of incoming air is constant all around a fan, with the flow resistance of incoming air kept low.

Specifically, in the first embodiment, the width of a slit, w, is continuously changed to make flow resistance equal in the intervals, with the same number of slits in the intervals while in the second embodiment, the width of a slit, w, and the number of slits, n, are changed at the same time to keep flow resistance constant in the intervals.

In other words, in the second embodiment, the width of a slit, w, on the four sides (intervals 7*s*), is made smaller, compared with other intervals, and the number of slits, n, is increased.

As is the case with the first embodiment, the amount of incoming air through one slit per unit time, Q, is expressed as follows:

$$Q=\Delta P\cdot w^3/(12\cdot\theta\cdot L)$$

where w is the width of a slit, L is the length of the slit, u is the air velocity, Q is the amount of incoming air through one slit per unit time, ΔP is the difference across the slit, and θ is the viscosity of air.

Since the number of slits is also changed in the second embodiment, the total amount of incoming air through n slits, ΣQ, is given by the equation below, assuming that the number of slits is n.

$$\Sigma Q = n \cdot \Delta P \cdot w^3/(12 \cdot \theta \cdot L)$$

where θ is the viscosity of air. ΔP depends on the rotating speed of the fan 1. Since θ, the viscosity of air, is constant everywhere, a requirement for keeping ΣQ constant is written as $$n \cdot w^3/L = \text{constant}.$$

Thus in the second embodiment, the amount of incoming air is made constant all around the fan by reducing the width w and increasing the number of slits, n, according to the above equation on the four sides, where L is small; that is, in this embodiment, setting the number of slits in the intervals 7*r* at 3 and that of slits in the intervals 7*s* at 4.

The above equation shows that the Reynolds number Re can be kept smaller, compared with the first embodiment, where flow resistance is set the same, to prohibit turbulent flow, because the width of a slit, w, in the interval 7*s* can be made smaller than in the case of the first embodiment in exchange for increasing the number of slits in the interval 7*s*, n.

This arrangement provides a blower that restricts blade vibration and disk circulation to prevent a P-Q characteristic deterioration and reduce noise to its full extent.

The width of a slit 6 in the interval 7*s* is set larger at its ends (portions adjacent to intervals 7*r* ) than in the middle of the interval 7*s* to reduce variations in the amount of incoming air at boundary points between intervals 7*s* and 7*r* where the number of slits changes.

Similarly, the width of a slit 6 in the interval 7*r* is set smaller at its ends (portions adjacent to intervals 7*s* ) than in the middle of the interval 7*r* to reduce variations in the amount of incoming air at boundary points between intervals 7*s* and 7*r* where the number of slits changes.

Figure 6:
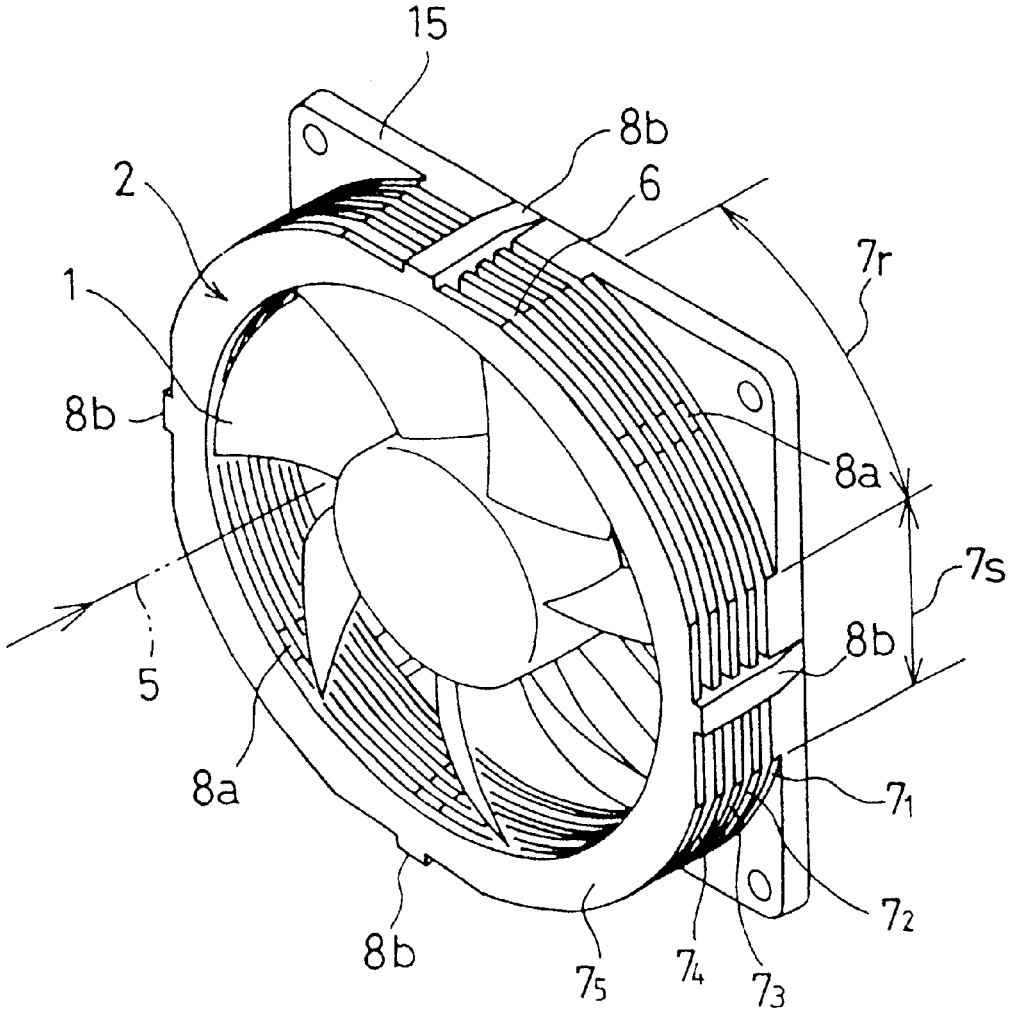
FIG. 6 is a perspective view of an axial-flow blower of a third embodiment.

FIG. 6 shows the third embodiment. The blower has slits 6 in an annular wall 2 surrounding an axial-flow fan 1. Specifically, annular plates $\mathbf{7}_1$ through $\mathbf{7}_5$ whose four corners are cut to fit in a rectangular casing body 15 are stacked with spacers 8 in between, and a slit 6 is formed between any two annular plates next to each other.

The spacers 8 forming and keeping the slits 6 are four spacers 8*a*, which are in intervals 7*r* corresponding to the four corners of the casing body 15, and four spacers 8*b*, which are in intervals 7*s* located in the middle of the four sides of the casing body.

As described above, arranging the spacers 8*b* in the intervals 7*s* where the radial length of an annular plate, L, is shortest reinforces weak portions of an annular plate. The spacers 8*b* are slightly protruded toward the outer perimeter of the annular plates, and the protruded portions are tapered along the axis of rotation.

Figure 7A:
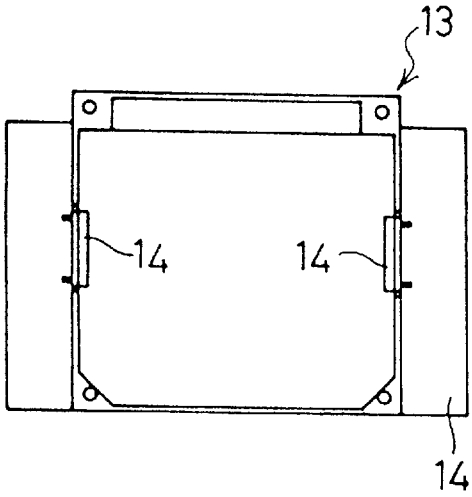
FIGS. 7*a* through 7*c* are a front view, a side view, and a bottom view of fixtures for a blower, respectively.
Figure 7B:
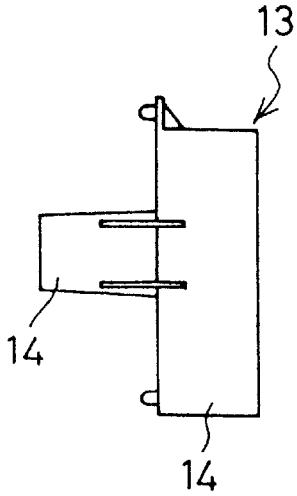
Figure 7C:
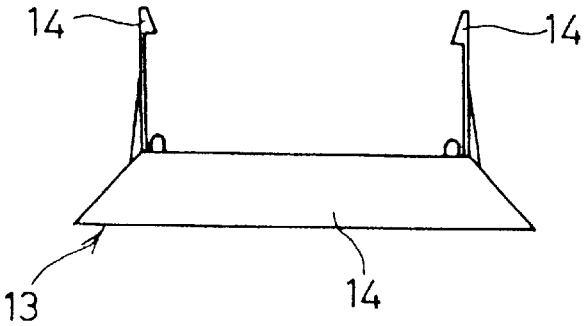

FIGS. 7*a*, 7*b*, and 7*c* show a fixture 13 of a blower for casings of personal computers, workstations, and so on. The fixture 13, made entirely of resin, is formed integrally with hooks 14 securing a blower. To secure the blower, it is pushed in between hooks 14, 14, which apply a spring force to the blower.

In the blower of the third embodiment, the spacers 8*b* are slightly protruded outwardly from the annular plates $\mathbf{7}_1$ through $\mathbf{7}_5$ to prevent the annular plates from being damaged by the hooks 14 caught between the annular plates $\mathbf{7}_1$ through $\mathbf{7}_5$ and from deforming under an undue load when a blower is pushed in.

In addition, the protruded portions of the spacers 8*b* are tapered to reduce load exerted on the blower when it is pushed in and increase the ease with which the blower is handled.

It goes without saying that a blower at a high performance level that features not only an improved P-Q characteristic and reduced noise but strength enough for practical use can be provided by forming the spacers in the first and second embodiments like a spacer 8*b* of the third embodiment.

Figure 8A:
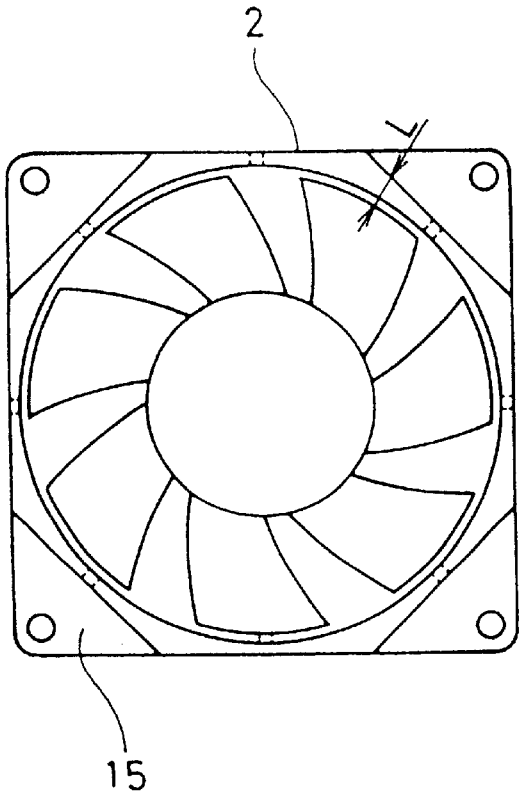
FIGS. 8*a* and 8*b* are a front view and a side view of another blower of the first embodiment, respectively.
Figure 8B:
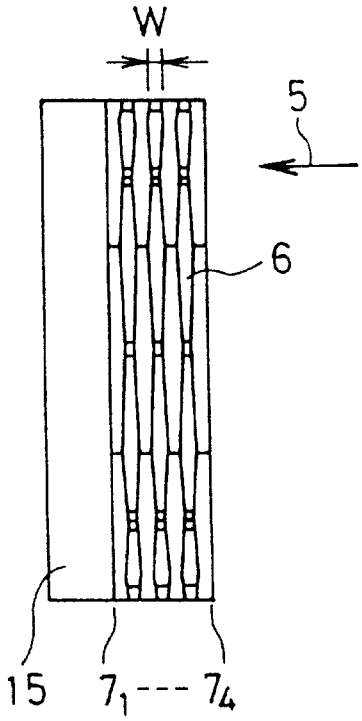
Figure 9A:
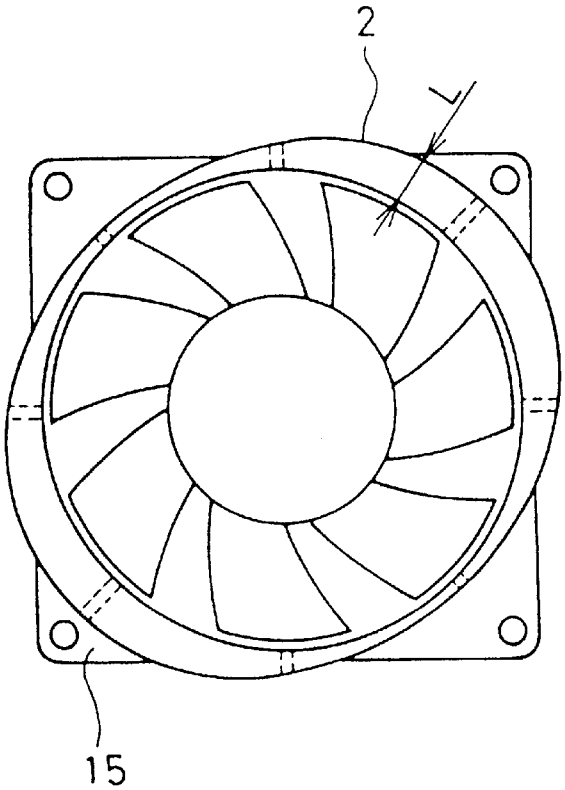
FIGS. 9*a* and 9*b* are a front view and a side view of still another blower of the first embodiment, respectively.
Figure 9B:
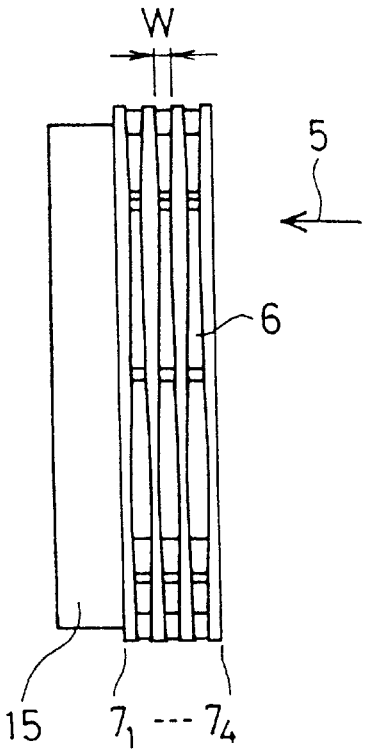

In the above embodiments, the casing bodies are rectangular, and the annular walls of a circular contour are partially cut to provide them with four flat surfaces. However, even when the contour of an annular wall is polygonal as shown in FIGS. 8*a* and 8*b* or oval as shown in FIGS. 9*a* and 9*b*, continuously changing the width of a slit, w, so that the requirement expressed by the equation below, $$w^3/L = \text{constant}$$

where w and L are the width and length of the slit, respectively is met, makes constant the flow rate of incoming air through each slit all around a fan and provides a blower featuring a good P-Q characteristic and reduced noise.

The first embodiment and FIGS. 8*a*, 8*b*, 9*a*, and 9*b* show three examples of an annular wall contour, any of which provides a blower featuring a good P-Q characteristic and reduced noise if the width of a slit is changed under the same conditions.

Figure 10A:
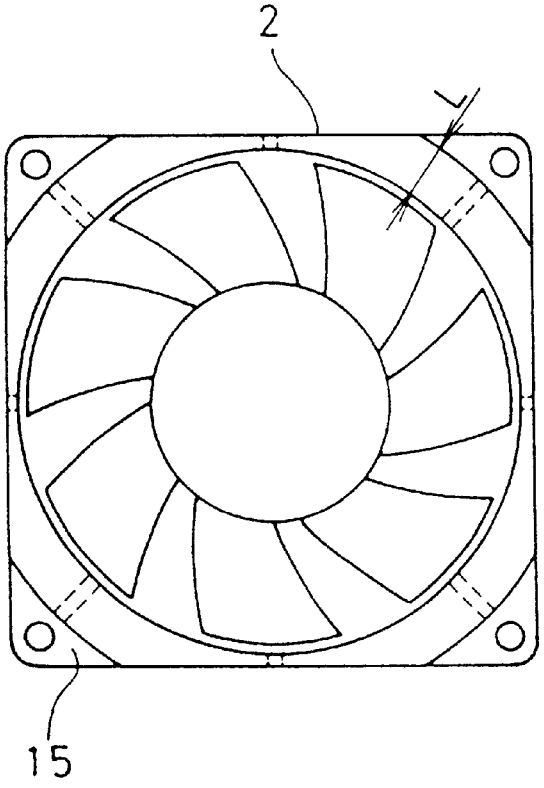
FIGS. 10*a* and 10*b* are a front view and a side view of a blower with slits having an intermittently changing contour, respectively.
Figure 10B:
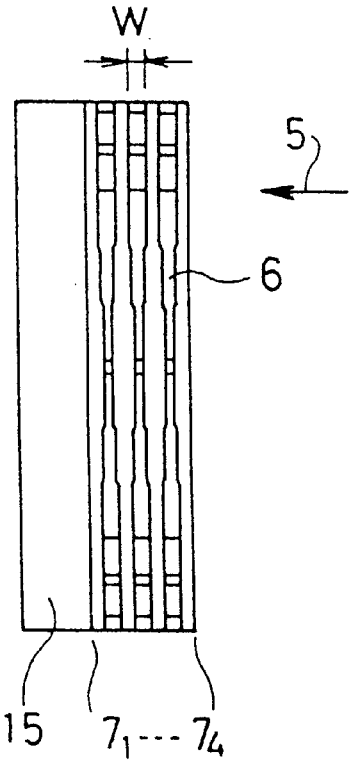
Figure 11:
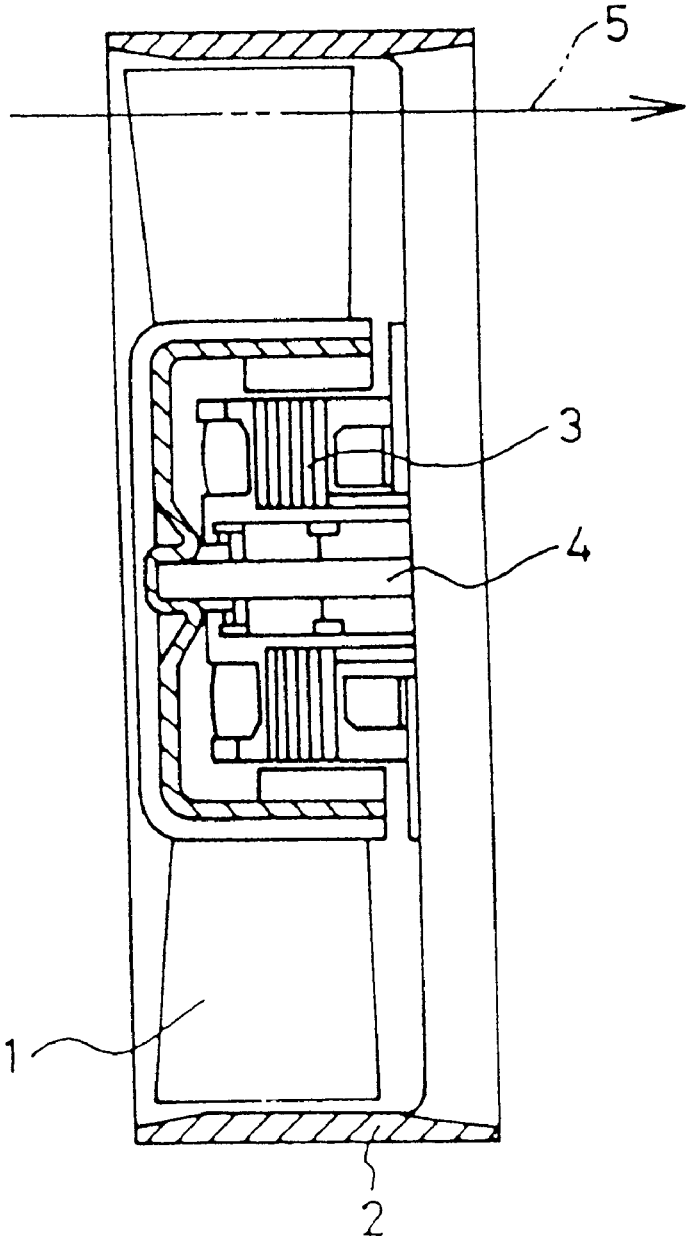
Fig.11 PRIOR ART
FIG. 11 is a cross-sectional view of a conventional axial-flow blower.
Figure 12:
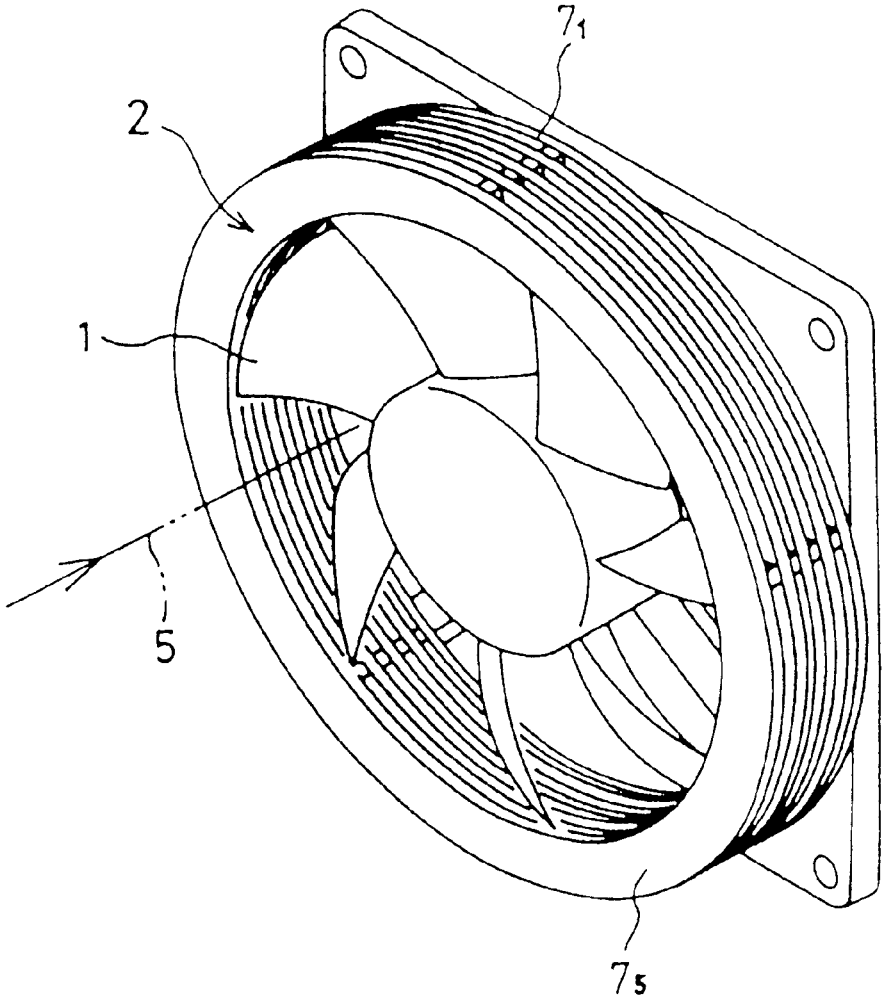
Fig.12 PRIOR ART
FIG. 12 is a perspective view of a blower with slits which is according to a preceding patent application.
Figure 13A:
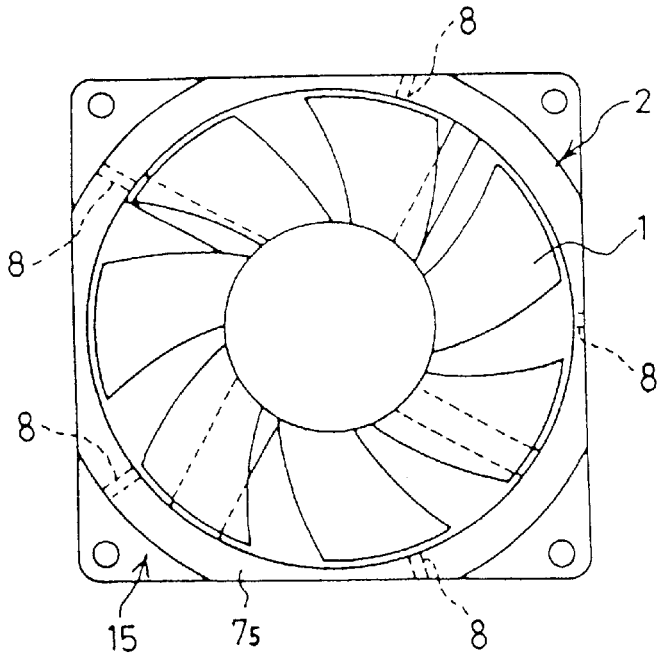
Fig.13a PRIOR ART
FIGS. 13*a* and 13*b* are a front view and a side view showing the blower with slits which is according to the preceding patent application, respectively.
Figure 13B:
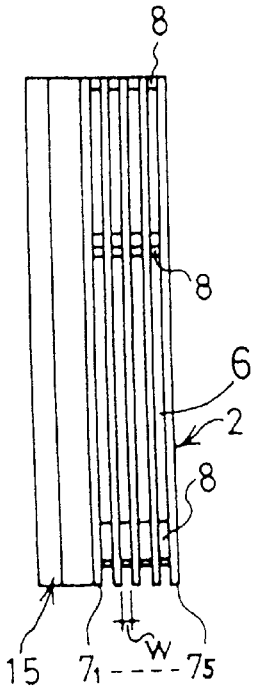
Fig.13b PRIOR ART

In the above embodiments, the width of a slit is continuously changed. On the other hand, when the width is intermittently changed as shown in FIGS. 10*a* and 10*b*, better performance can be ensured, compared with FIGS. 13*a* and 13*b*, in which the width of a slit is constant, though the performance is a littler lower, compared with FIGS. 1*a* through 1*c*, in which the width of a slit is continuously changed. Intermittently changing the width of a slit as in FIGS. 10*a* and 10*b* allows the contour of a slit to be simpler than continuously changing the width, so that the slit can easily be formed, thus leading to a low blower cost. Thus a high cost-per-performance blower can be provided.

Figure 14A:
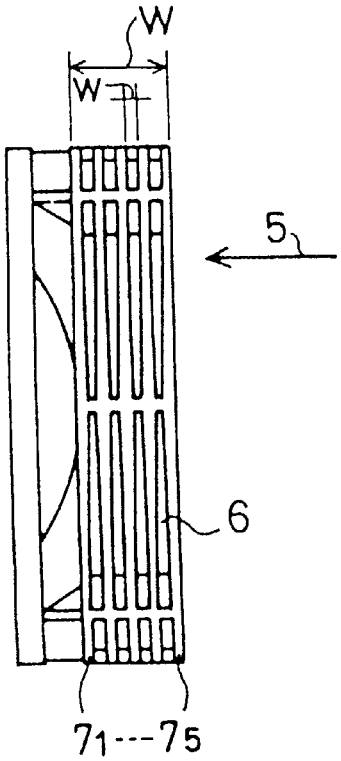
FIGS. 14*a* through 14*c* are a side view, a front view, and a cross-sectional view of a blower of a fourth embodiment, respectively.
Figure 14B:
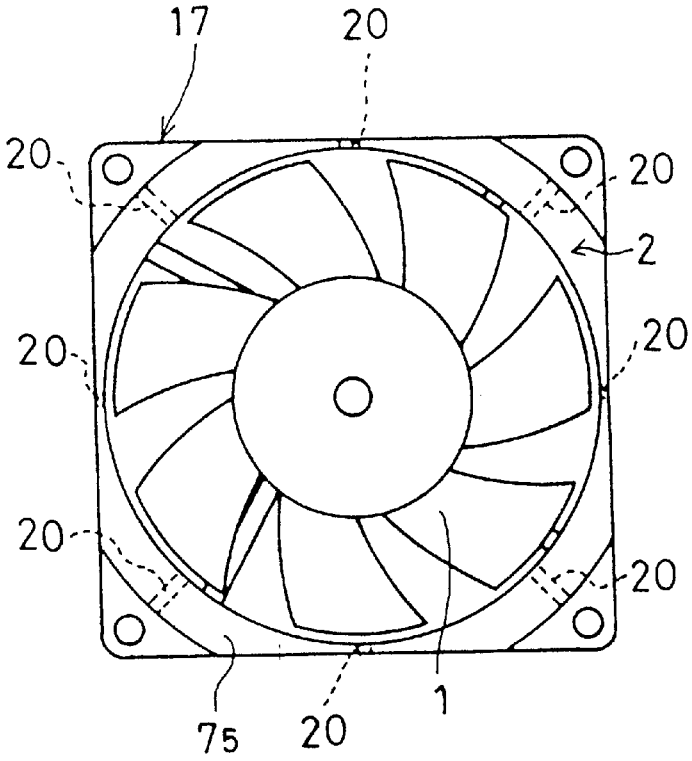
Figure 14C:
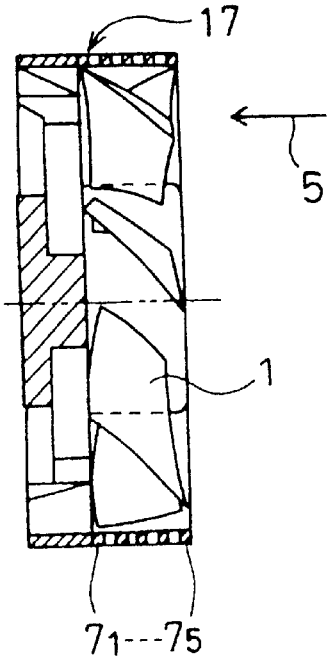

FIGS. 14*a* through 14*c* show a blower of the fourth embodiment. As shown in FIG. 14*c*, the width of the annular plates $\mathbf{7}_1$ through $\mathbf{7}_5$, W, may be set equal or substantially equal to that of an axial-flow fan 1 in the direction of its axis. The width of each slit, w, is changed so that flow resistance is almost equal at every location.

Driving the axial-flow fan 1 to rotate it produces negative pressure on the back pressure side at the end of a blade, so that the pressure difference across the slit 6 causes an air flow 5 to go inwardly through the slit. Setting the width of a slit 6, w, to an appropriate value makes the air flow, going through each slit 6, laminar, which inhibits leakage vortices flowing from the positive pressure side to the back pressure side and eliminates flow separation on the back pressure surface of a blade. This, in turn, means that the P-Q characteristic is improved and that noise is reduced.

Figure 15A:
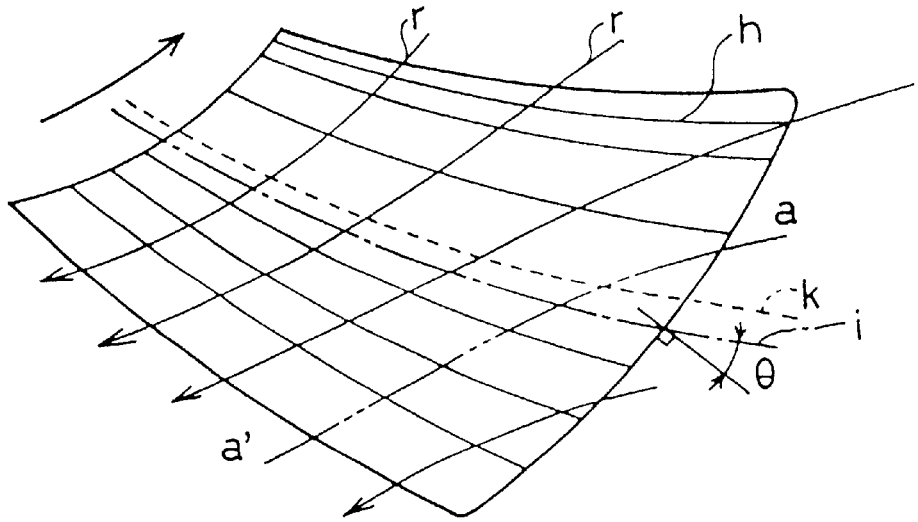
Fig.15a PRIOR ART
FIGS. 15*a* and 15*b* are an equi-thickness diagram and a cross-sectional view of a conventional fan.

As shown in FIG. 15*a*, a conventional blade has a shape formed by radially jointing together blades whose cross-sections obtained by cutting them through the surfaces of cylinders concentric with the rotational axis are airfoils. This is because a conventional fan is designed, with radial air flow neglected. However, calculated values and actual values do not disagree widely as long as a fan has an annular wall through which air does not come in from outside and the flow resistance of air is relatively low. To improve fan characteristic when the flow resistance of air is a little larger than in the case above, advance blades are generally used, the middle of which in the direction of their chords is inclined toward the direction of rotation.

In FIG. 15*a*, a thin line h is an equi-thickness line (line passing through locations at which a blade has the same thickness) showing the thickness of a blade, an alternate long and short dash line i is the center line of a chord which is provided when the blade is cut through the surface of a concentric cylinder, and a broken line k shows the locations at which the largest thickness is provided when the blade is cut through the surface of a concentric cylinder.

Figure 15B:
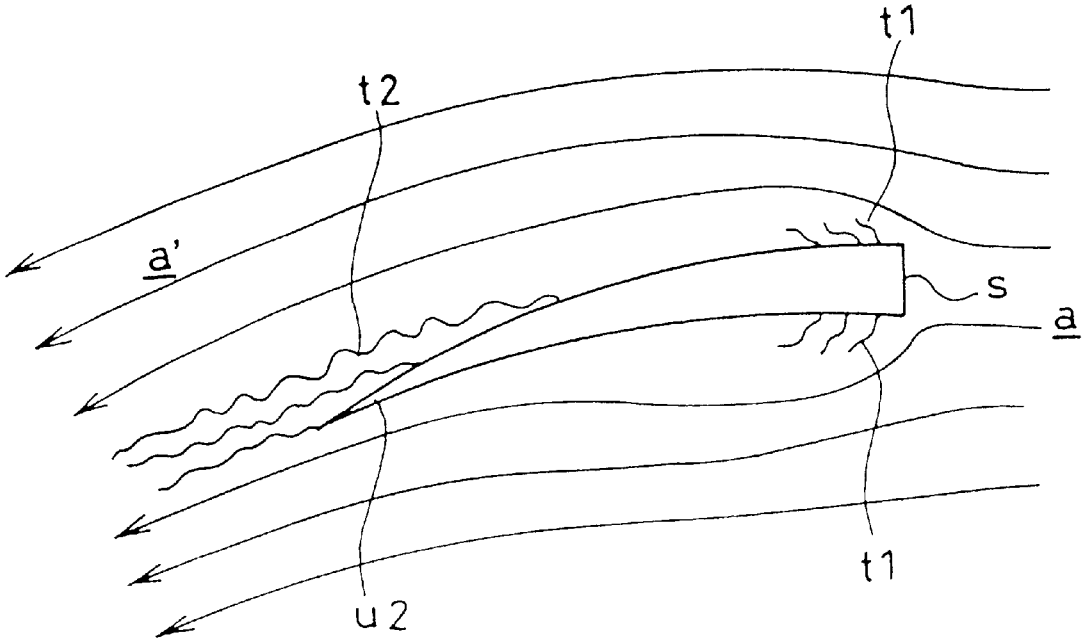
Fig.15b PRIOR ART

A combination of the conventional fan and a housing 17 with slits formed in the annular wall causes air to flow over the blades of the fan in the direction as indicated by an arrow r in FIG. 15*a*. FIG. 15*b* shows the cross section of the blade taken along an alternate long and two short dashes line a—a' along the air flow.

Because the blade is relatively thick near the ends thereof as shown in FIG. 15*b*, an air flow flowing in the surroundings of the end hits against the end surface, thus causing an air layer to easily separate near both edges t1 at the end.

The blade thickness distribution, on which the performance of a blade depends largely, is far from the thickness distribution of an ideal airfoil series. Thus airfoil effects are not likely to produce lift, and air layer separation t2 is ready to occur on the blade trailing edge side u2.

A conventional fan is described below in greater detail to compare it in arrangement with an axial-flow fan 1 of the present invention. The conventional fan is arranged as shown in FIGS. 16*a* and 17*a* through 17*d*.

Figure 16A:
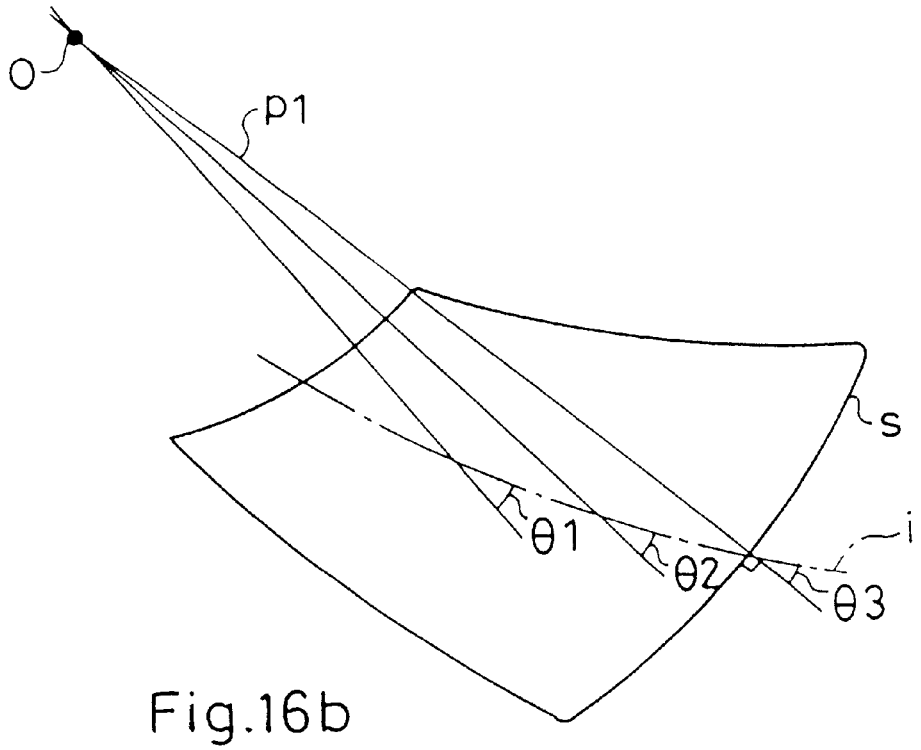
Fig.16a PRIOR ART
FIG. 16*a* is a diagram illustrating the shape of a conventional blade.

As shown in FIG. 16*a*, the cross sections of a blade of the conventional fan which are obtained by cutting the blade through the surfaces of concentric cylinders are a series of airfoils of the same system. For every cross section, blade advance angles θ1, θ2, and θ3 are the same which are made by a straight line p1, passing through the center of rotation of the blade, o, and the center line of the chord, i.

Figure 17A:
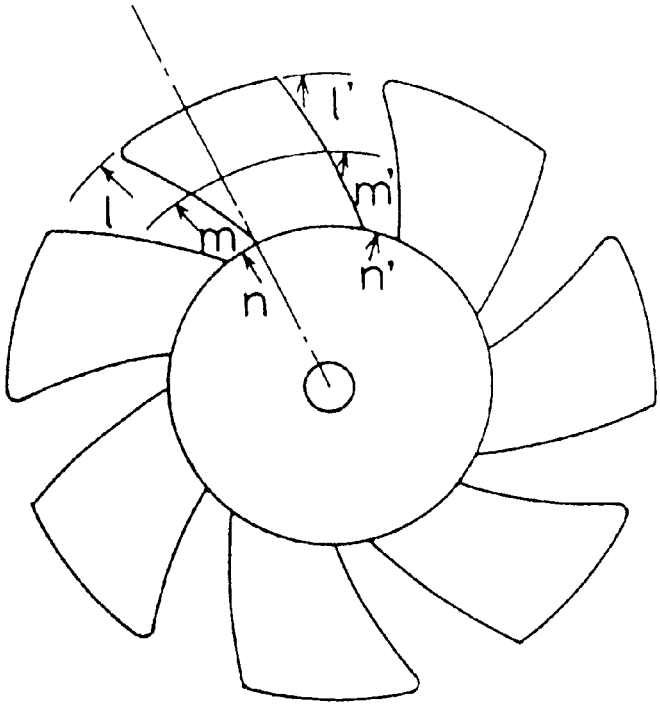
Fig.17a PRIOR ART
FIGS. 17*a* through 17*d* are a front view of a conventional fan and cross-sectional views illustrating thicknesses of a blade at various locations, respectively.
Figure 17B:
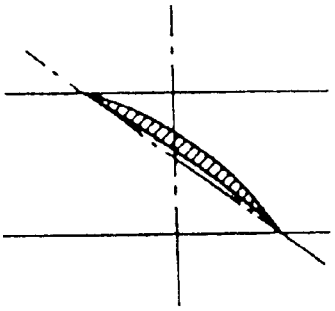
Figure 17C:
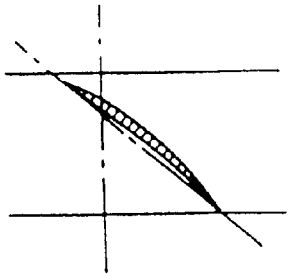
PRIOR ART Fig.17c
Figure 17D:
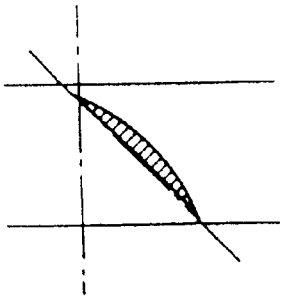
PRIOR ART Fig.17d

Blade thickness of a conventional fan changes along lines 1–1', m–m', and n–n' in FIG. 17*a* are as shown in FIGS. 17*b*, 17*c*, and 17*d*, respectively.

FIGS. 16*b* and 18*a* through 20 show an axial-flow fan 1 of the present invention provided by taking measures against these problems.

Figure 18A:
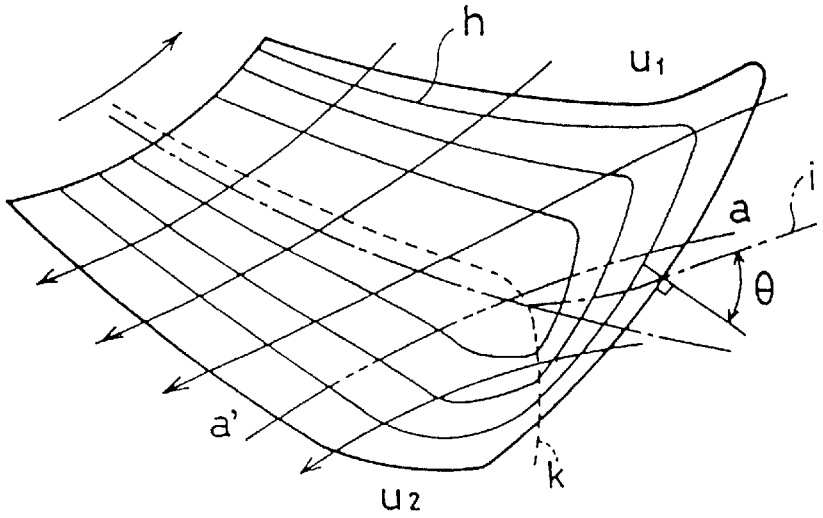
FIGS. 18*a* and 18*b* are an equi-thickness diagram and a cross-sectional view of a blower of the fourth embodiment, respectively.
Figure 18B:
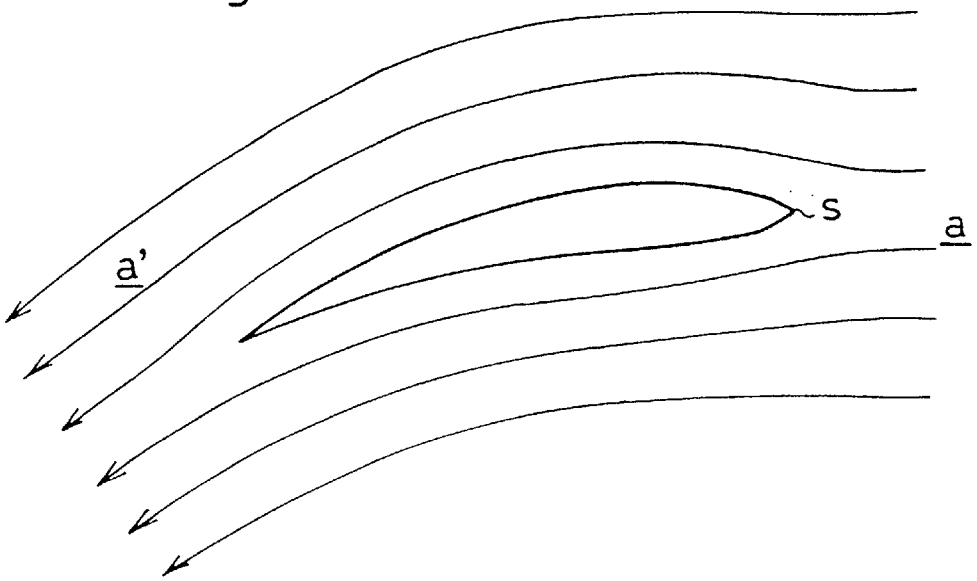
Figure 19A:
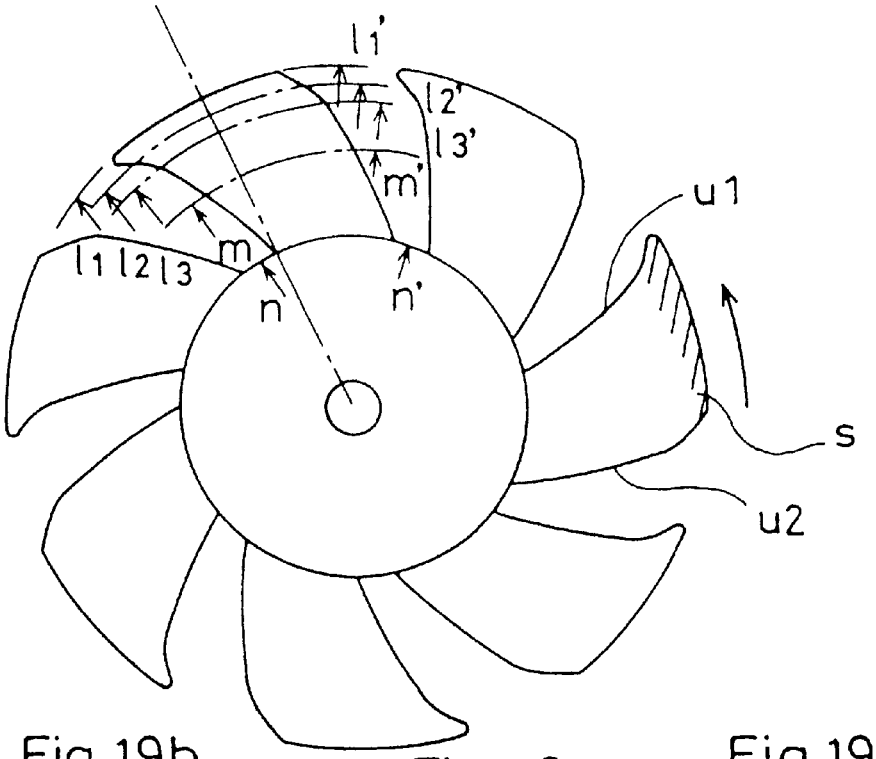
FIGS. 19*a* through 19*f* are a front view of the fan of the fourth embodiment and cross-sectional views showing thicknesses of a blade at various locations, respectively.
Figure 19B:
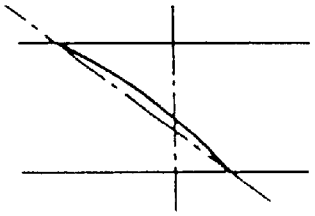
Figure 19C:
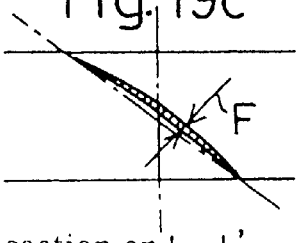
Figure 19D:
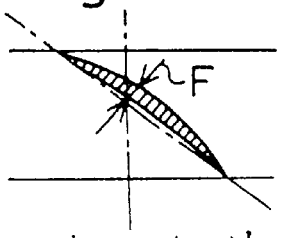
Figure 19E:
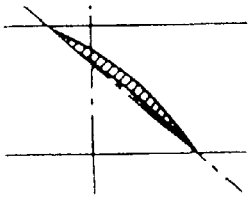
Figure 19F:
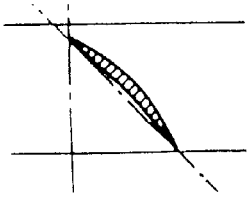

In FIG. 18*a*, a thin line h is an equi-thickness line showing the thickness of a blade, an alternate long and short dash line i is the center line of a chord which is provided when the blade is cut through the surface of a concentric cylinder, and a broken line k shows the locations at which the largest thickness is provided when the blade is cut through the surface of a concentric cylinder. The cross section of the blade taken along an alternate long and two short dashes line a–a' along the air flow is formed to be an airfoil as shown in FIG. 18*b*.

Figure 16B:
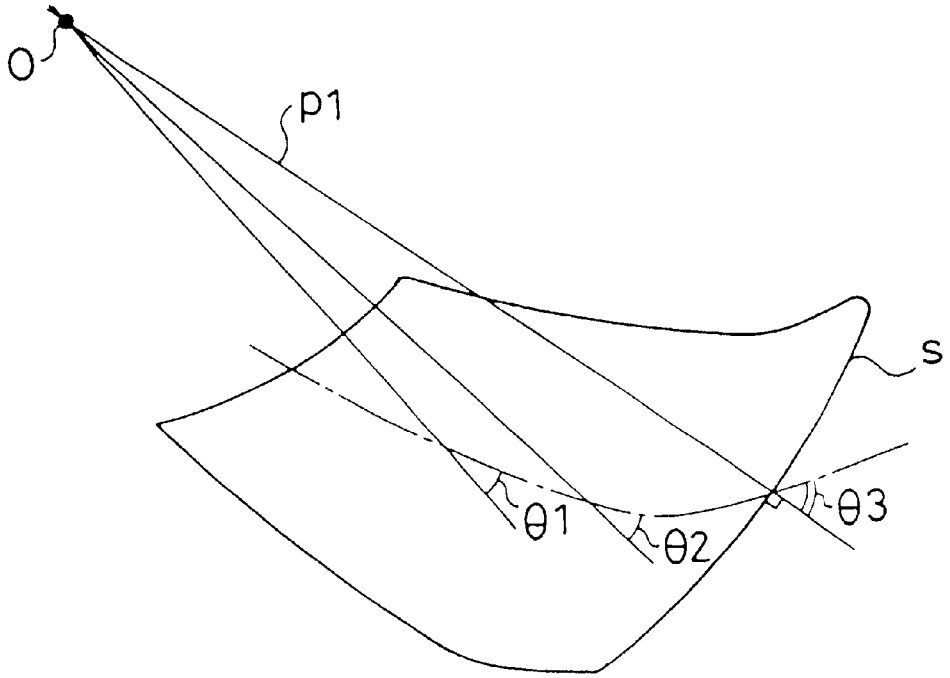
FIG. 16*b* is a diagram illustrating the shape of a blade according to the present invention.

As shown in FIG. 16*b*, blade advance angles θ1, θ2, and θ3 are formed so that the angle θ1 at the end of the blade is larger than the other two; that is, the blade end s is bent so that it advances in the direction of rotation.

The airfoil is almost the same as in the case of the conventional fan except at the blade end, but the thickness on the side of the blade end s gradually becomes thinner and the location k at which blade thickness is the largest is near a trailing edge side u2. u1 denotes a leading edge side.

In detail, the cross sections taken along lines $\mathbf{1}_1$–$\mathbf{1}_1$', $\mathbf{1}_2$–$\mathbf{1}_2$', $\mathbf{1}_3$–$\mathbf{1}_3$', m–m', and n–n' are as shown in FIGS. 19*b* through 19*f*, respectively. F denotes the location at which the maximum thickness is provided.

An axial-flow fan 1 of the present invention has the following improvements over the conventional fan.

First, a blade 16 of the axial-flow fan 1 progressively becomes thinner toward the blade end s.

Second, the location F at which an airfoil of the blade 16, obtained by cutting the blade 16 through the surface-of a cylinder concentric with the axis of rotation, is the thickest gradually moves back toward the trailing edge side u2 as the location approaches the blade end s.

Third, the blade advance angle θ3 near the blade end s is larger than that in other locations.

Fourth, the blade inclination angle of the blade end s matches the slit angle and is perpendicular to the axis of rotation.

As shown in FIG. 18*b*, the above arrangements allow the airfoil to fully exercise effects on air flowing in from outside the annular wall. Moreover, because of the arrangements, air smoothly flows through the slits to the blade ends, air flowing from the blade ends produces lift under the influence of the airfoil, and air layer separation is prevented on the blade trailing edge side. This means that the P-Q characteristic of the blower is improved, since air flowing through the slits can effectively be converted into air flow.

In the embodiment, the blade advance angle θ3 near a blade end should be set so that it satisfies the following equation:

$$\theta 3=\tan^{-}(v/u)$$

where v is the average velocity of air flowing in from outside the annular wall, and u is the peripheral speed of the blade end.

The setting according to the above equation makes air flow from outside the annular wall almost parallel to the blade ends, thus helping air smoothly flow in. This is the most advantageous in improving the P-Q characteristic and reducing noise.

Figure 20:
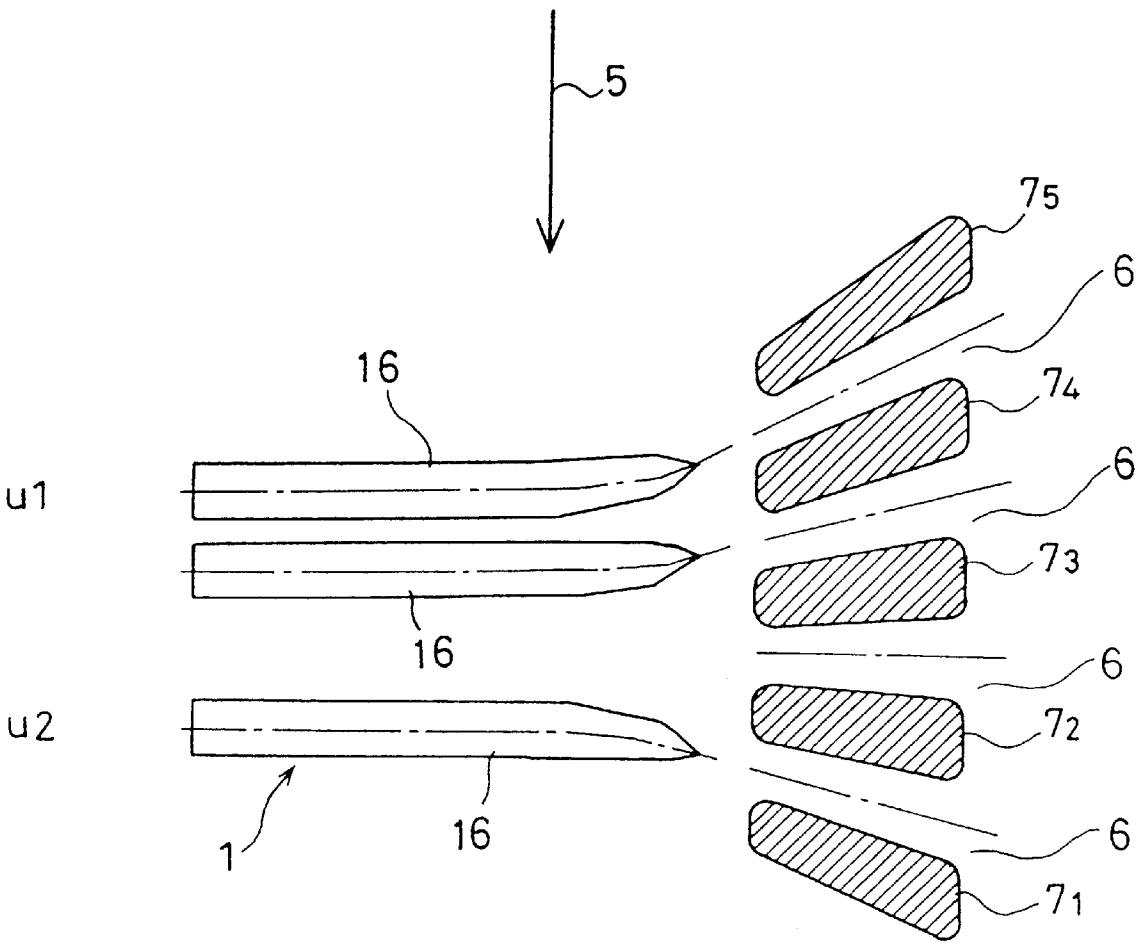
FIG. 20 is a cross-sectional view showing the relationship between the slits and blade of the fourth embodiment.

In the embodiment, the slits 6 in the annular wall 2 are formed in a plane perpendicular to the axis of rotation of the fan. When the slits are inclined up on the leading edge side ul (up the air flow 5) and down on the trailing edge side (down the air flow 5) as shown in FIG. 20, changing the inclination angle of the blade end continuously so that the angle is equal to the slit angle prompts air to smoothly flow in and improves the P-Q characteristic. In FIG. 20, the blades 16 are blade cross sections obtained by cutting blades at several locations along planes containing the axis of rotation 4.

Figure 21A:
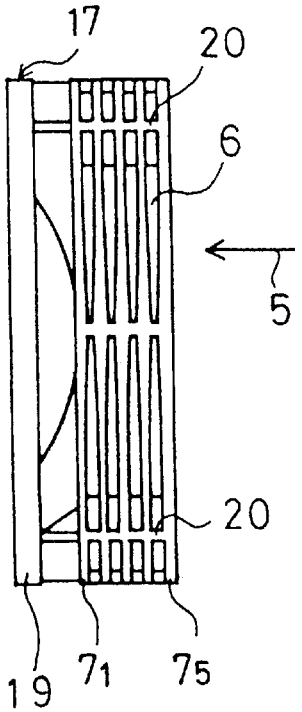
FIGS. 21*a* through 21*c* are a side view, a front view, and a cross-sectional view of a housing of a fifth embodiment, respectively.
Figure 21B:
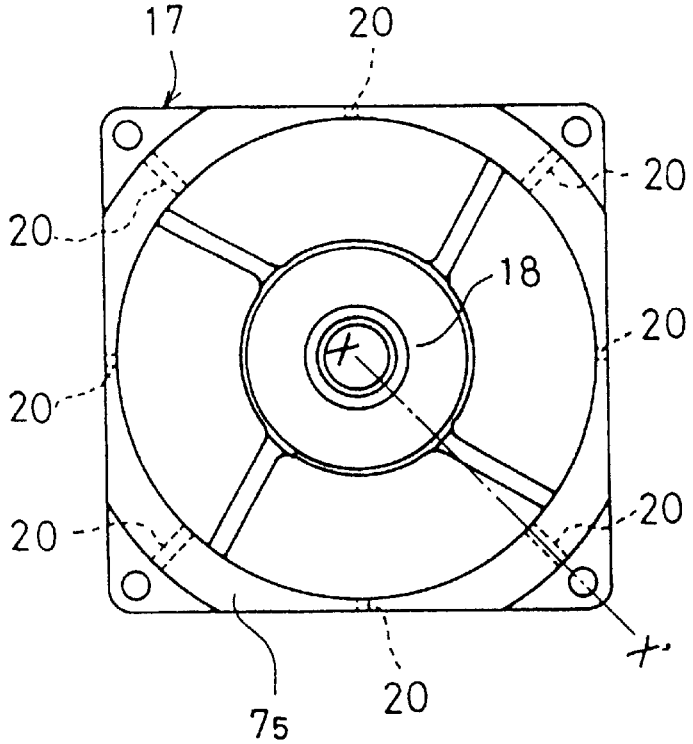
Figure 21C:
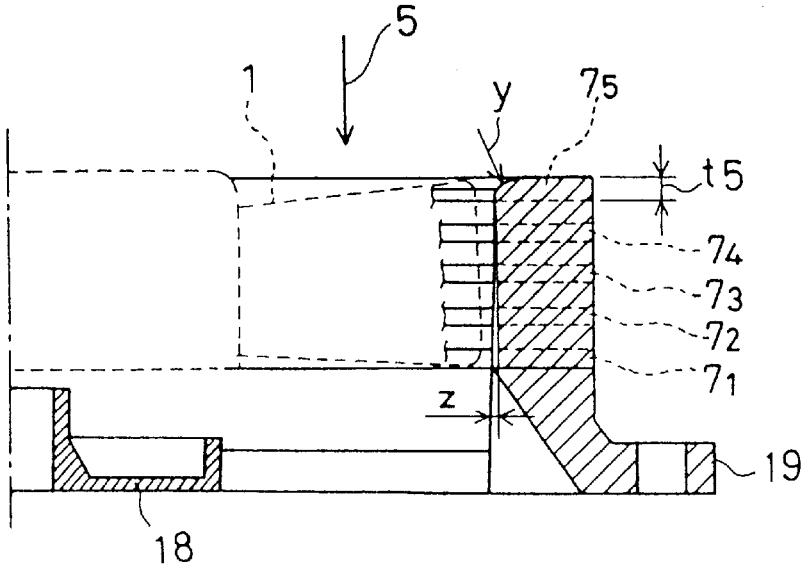

FIGS. 21*a* through 21*c* show another embodiment of the housing 17. An axial-flow fan 1 is the case with the fourth embodiment. A housing 17 in the fifth embodiment is nearly the same as in the case of the fourth embodiment. The thickness t5 of the annular plate $\mathbf{7}_5$ on the top stage is larger than those of the other annular plates $\mathbf{7}_1$ through $\mathbf{7}_4$. The annular plate $\mathbf{7}_5$ differs from the others only in that the upper edge y of the inner surface of the annular plate $\mathbf{7}_5$ (the edge is up an air flow 5) is cut to be arcuate as shown in FIG. 21*c* and that the inner surface of the annular plate $\mathbf{7}_5$ is tapered so that the inner circumference progressively becomes longer toward its upper end. z represents the step formed between the upper and lower ends by tapering the inner surface.

As shown in FIGS. 21*a* through 21*c*, the housing 17 has a boss 18, or a bearing support to which a motor is secured, and a base 19, a reference for blower installation. On top of the base 19, the annular plates $\mathbf{7}_1$ to $\mathbf{7}_5$, thin rings which are cut so that four straight sides are provided for each of them, are vertically jointed together with spacers 20 in between.

All of these parts are formed from resin by injection molding so that they are monolithic.

The housing 17 undergoes loads, including loads due to tools for blower assembly and an operator's hands, abnormal loads due to falls and shock in transit, and loads for supporting a blower which act on the housing whenever the blower is incorporated in equipment. Because the annular plate $7_5$ on the top stage is exposed outside, it is the most liable to be subjected to load of all the annular plates.

Aerodynamically, making the annular plates $7_1$ to $7_5$ thinner allows the opening of the annular wall 2 to be set larger, thus enabling air flow resistance to be reduced. Although this is advantageous for the P-Q characteristic, load strength is lowered. In the embodiment, the annular plate $7_5$ on the top stage, which is the most liable to be subjected to load of the annular plates $7_1$ through $7_5$, is made thicker than the remaining annular plates $7_1$ through $7_4$ to balance load strength with the P-Q characteristic.

Further, in the embodiment, air is directed along the arcuate surface, formed by cutting the upper edge y of the inner surface of the annular plate $7_5$ which is the most upstream, to reduce the effect of making the annular plate $7_5$ on the top stage thicker than the other annular plates $7_1$ through $7_4$.

Being formed from resin, the housing 17 changes in dimensions with time or has varied dimensions originally. The clearance between a blade end and the internal surface of the annular wall must be kept relatively small to improve the P-Q characteristic, but too small a clearance causes a blade end to come in contact with the internal surface of the annular wall, thus resulting in malfunction, an early defect, and so on.

In the embodiment, the step z is provided so that the clearance between the axial-flow fan 1 and the annular wall progressively becomes larger from the boss 18 to the top of the annular wall, that is, the internal surface of the annular wall is tapered to keep the clearance small while reducing the possibility that a blade end touches the annular wall when the axis of rotation of the fan inclines.

Figure 22A:
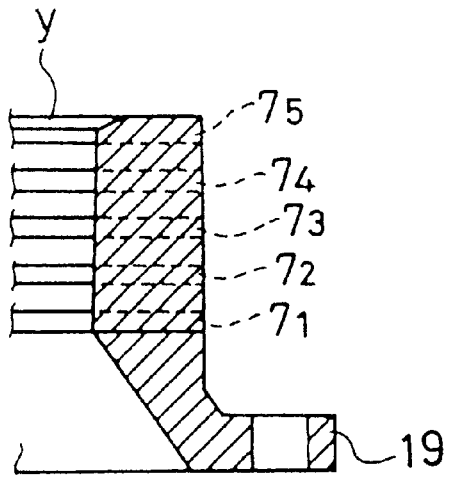
FIGS. 22*a* and 22*b* are cross-sectional views of another housing of the fifth embodiment, respectively.
Figure 22B:
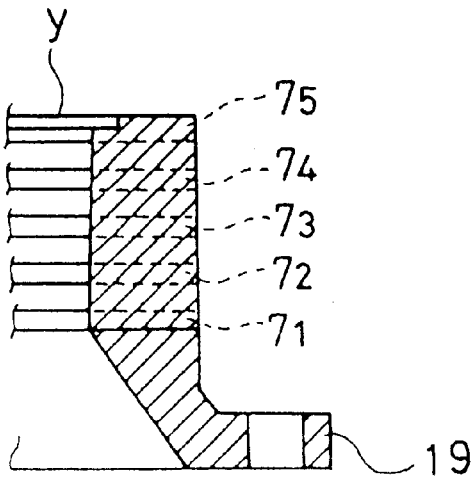

In the above embodiment, the upper edge y of the inner surface of the annular plate $7_5$ on the top stage is cut to be arcuate, but the same effect is exercised even when the edge is cut to be C-shaped as shown in FIG. 22*a* or to be formed in a multistep fashion as shown in FIG. 22*b*.

Figure 23A:
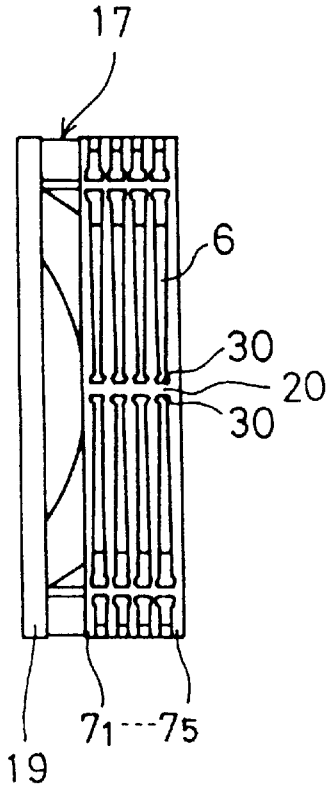
FIGS. 23*a* and 23*b* are a side view and a front view of a housing of a sixth embodiment, respectively.
Figure 23B:
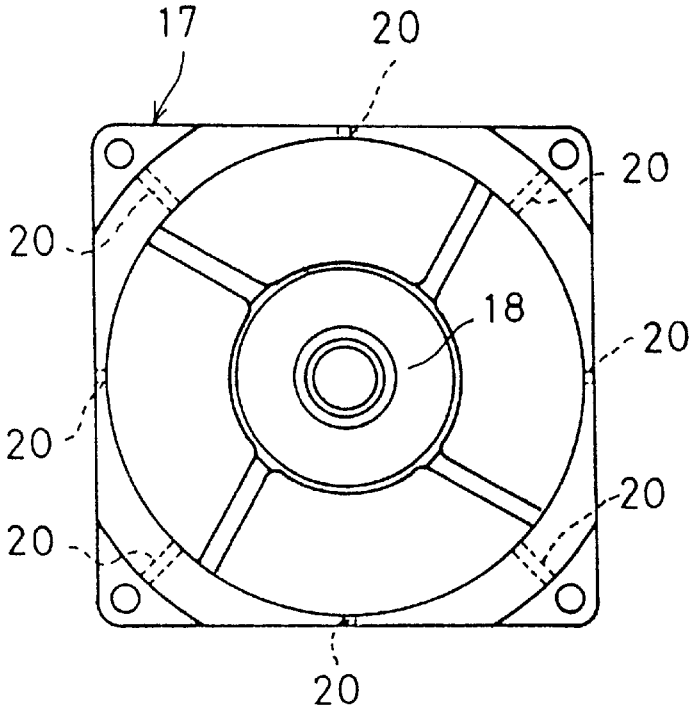

FIGS. 23*a* and 23*b* show another embodiment of the housing 9. An axial-flow fan 1 is the case with the fourth embodiment. The housing in the sixth embodiment is almost the same as in the fifth embodiment but only differs from the housing in the fifth embodiment in that the housing in the sixth embodiment has expanded sections 30 where the width of slits 6, w, is further increased near spacers 20 supporting annular plates $7_1$ through $7_5$.

The strength of the spacers 20 are essential to providing the housing 9 in the embodiment with satisfactory strength. When the spacers 20 are thickened to make a housing strong enough, the spacers 20 prevent air from flowing from outside the housing 21, thus causing the P-Q characteristic to deteriorate and noise to increase.

Figure 24A:
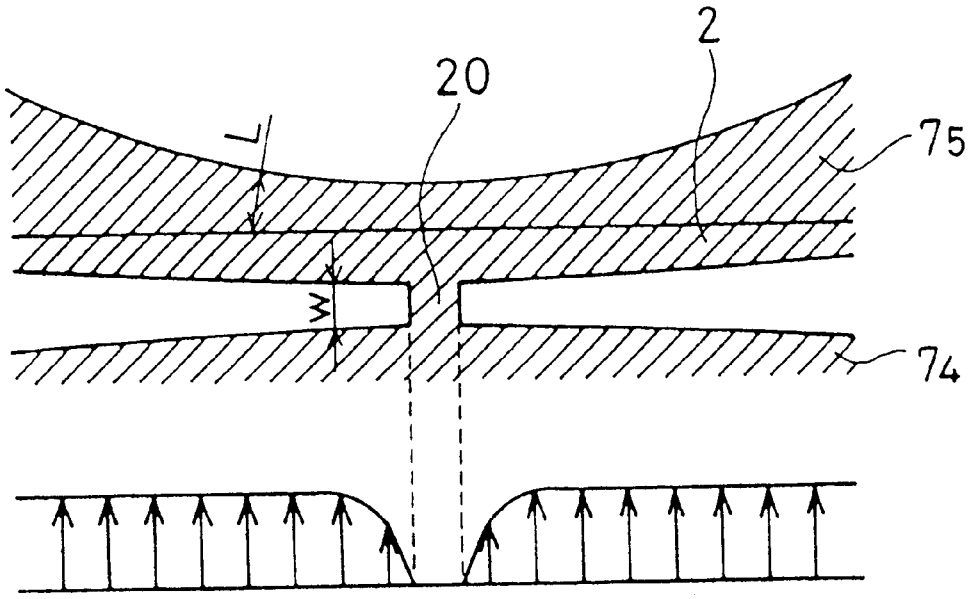
FIGS. 24*a* and 24*b* are a comparison of an air flow through a slit of the sixth embodiment and an air flow through a slit according to prior art, respectively.

FIG. 24*a* shows a slit 6 with a width w which is optimized under the condition below, using the radial length L of the slit 6 as a parameter:

$$w^3/L=\text{constant}.$$

In this optimization, the effect of the spacer 20 is not taken into consideration at all. The air flow rate at locations away from a space 20 is kept nearly constant under the condition above, but the rate decreases near the spacer 20 under its influence.

Figure 24B:
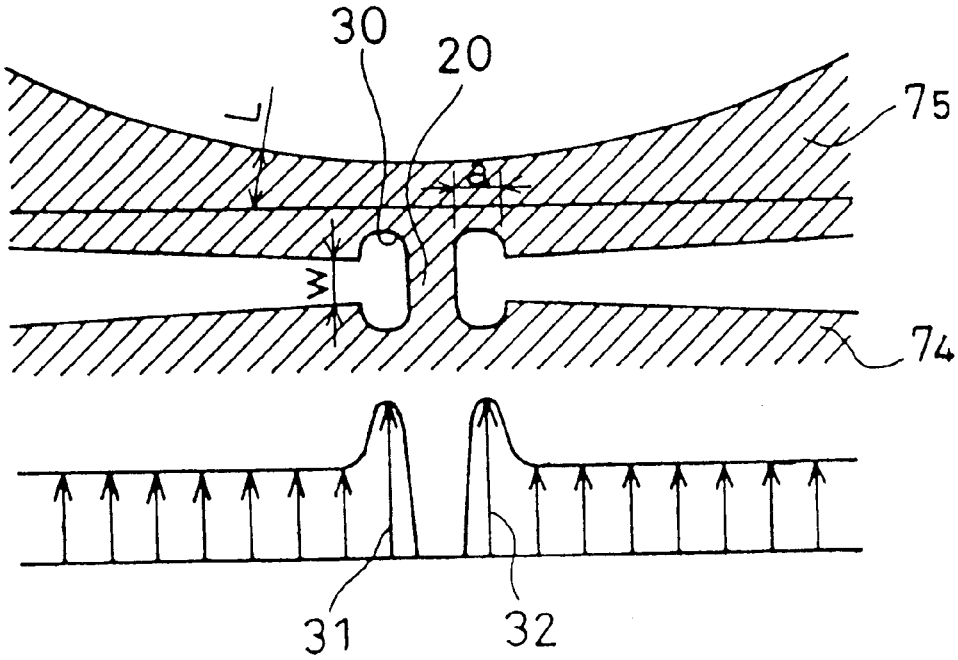
Fig. 24b PRIOR ART

FIG. 24*b* shows a slit 6 having a width w which is set larger only near the spacers 20 than the condition above by providing the expanded section 30.

As shown in FIG. 24*b*, in the embodiment, the air flow rate distribution is set so that the flow rate at sections 31 and 32 near the spacers 20 where the flow rate is large makes up for a decrease in flow rate at the spacers 20.

Thanks to the arrangement, the effect of the spacers 20 on flow resistance is canceled, the P-Q characteristic of a blower is fully exhibited, and noise is reduced.

However, since providing near the spacers 20 sections at which the flow rate is large may cause energy to sharply change, especially near the end of a blade of the axial-flow fan 1, the blades may resonate, producing high-frequency noise. The annular plates $7_1$ through $7_5$ partially become thinner, so that the strength thereof decrease. Thus, it becomes possible to provide a blower that has high-level P-Q characteristic and strength, with its noise reduced by setting the flow rate between them taking into account the P-Q characteristic, noise, and strength.

The width in the spacer thickness direction of an expanded section 30 where the width of the slit 6, w, is set relatively large, or a thickness a, must be equal to or smaller than that of a surrounding slit 6, w. Too large the value of a causes air flow through an expanded section 30 to become turbulent, thus contrarily lessening the effect of improving the P-Q characteristic and reducing noise.

As described above, according to the present invention, the strength of the annular plates decrease because they are partially thin. As shown in FIGS. 23*a*, 23*b* and 24*b* however, the expanded section 30 whose inner surface is formed to be arcuate allows stress concentration to be modified and strength (especially breaking strength) to increase when the joint between a spacer and an annular plate is loaded.

Figure 25A:
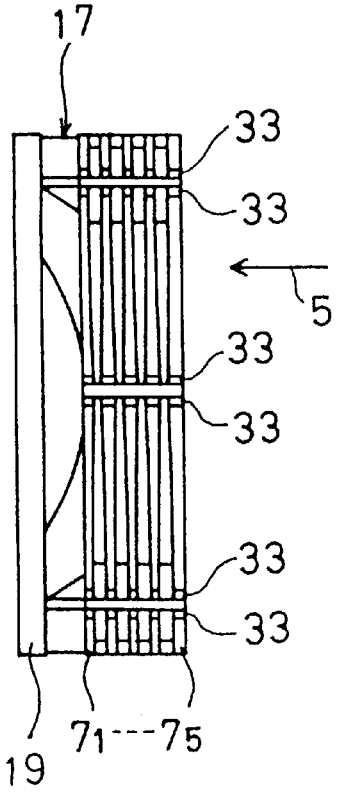
FIGS. 25*a* and 25*b* are a side view and a front view of a housing of a seventh embodiment, respectively.
Figure 25B:
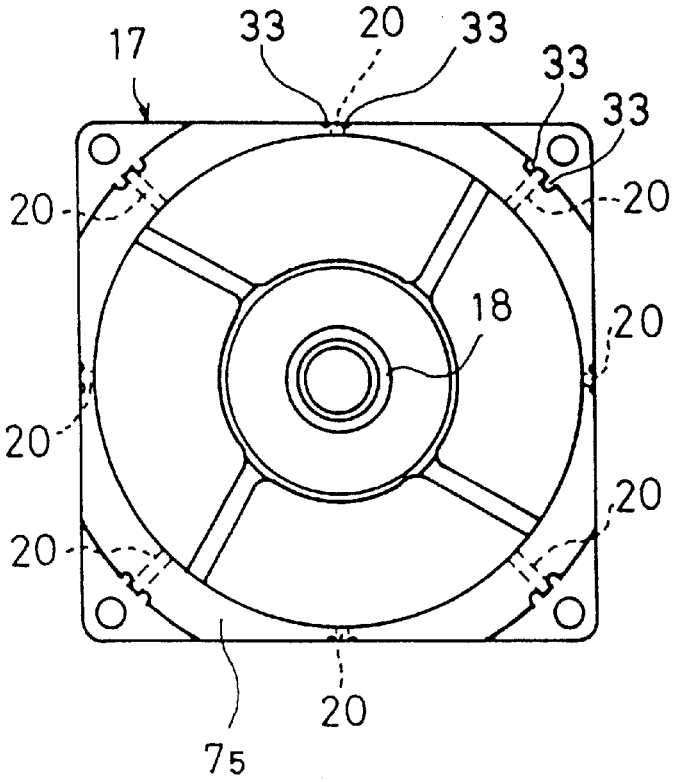

The seventh embodiment cancels the effect of spacers 13, using an arrangement differing from that used for the sixth embodiment. An axial-flow fan 1 is the case with the fourth embodiment. FIGS. 25*a* and 25*b* show a housing 17 in the seventh embodiment. The seventh embodiment only differs from the fifth embodiment in that the housing 17 is provided with notches 33 so that the radial length of annular plates $7_1$ through $7_5$ is short near spacers 20.

For this arrangement, properly setting the dimensions of the notches 33 enables the effect of the spacers 20 on flow resistance to be eliminated and the P-Q characteristic of the blower to be fully exhibited as is the case with the sixth embodiment.

For the housing 17 in the seventh embodiment, the width of a slit 6, which does not sharply change unlike the width of a slit in the sixth embodiment, can be set by adjusting only the contour of the annular plates $7_1$ through $7_5$. Thus the housing 17 is relatively easy to form and suited for mass production.

Figure 26A:
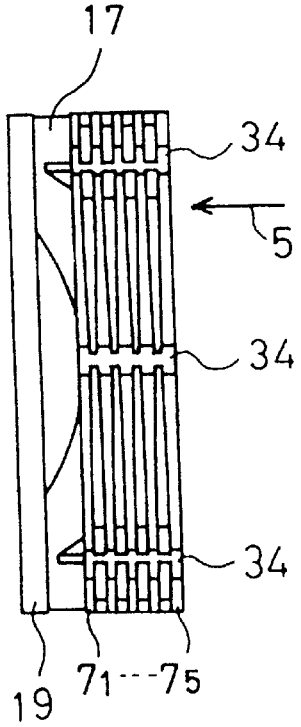
FIGS. 26*a* and 26*b* are a side view and a front view of another housing of the seventh embodiment, respectively.
Figure 26B:
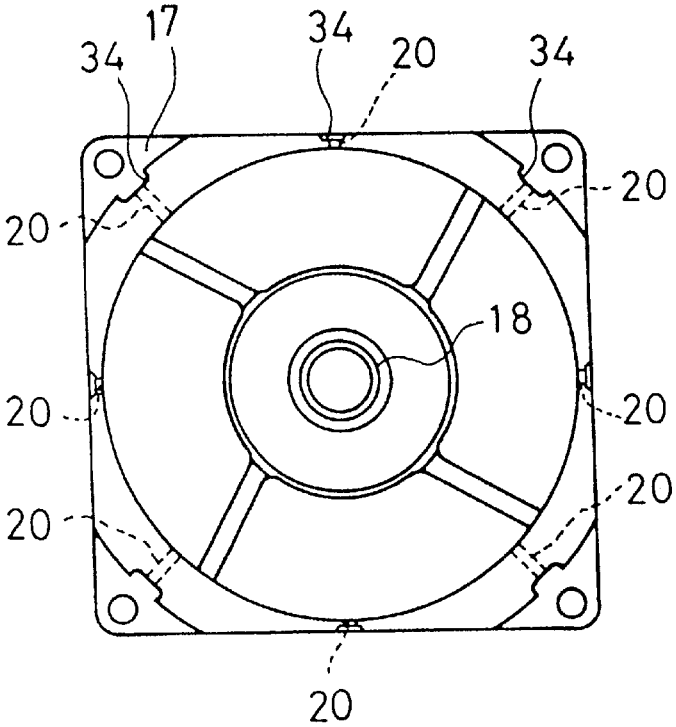

The housing in FIGS. 25*a* and 25*b* is provided only around the outer circumference of the annular plates $7_1$ through $7_5$ with the notches 33. Even when notches 34, including the outer surfaces of the spacers 20, are formed as in the housing 17 in FIGS. 26*a* and 26*b*, the housing has a little lower strength but exercises one and the same effect.

The fourth through seventh embodiments aim to improve the characteristics of a blower. On the other hand, although the eighth embodiment is a litter lower in performance than the other embodiments, it is intended to provide a high cost-per-performance blower by enhancing suitability for mass production and reducing part costs while minimizing a deterioration in performance.

Figure 27A:
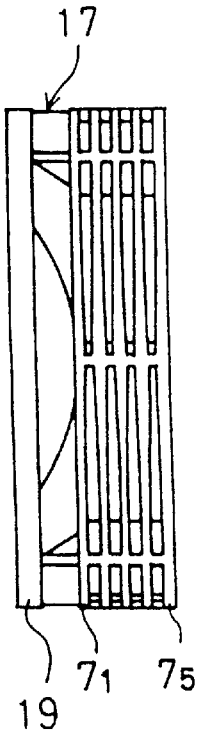
FIGS. 27*a* through 27*c* are a side view and a front view of a housing of an eighth embodiment and a detailed cross-sectional view of a spacer for the housing, respectively.
Figure 27B:
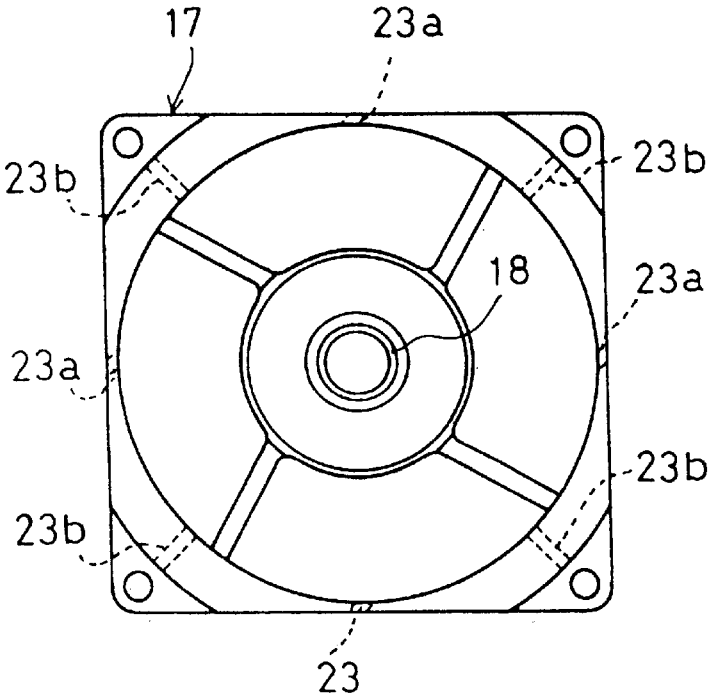
Figure 27C:
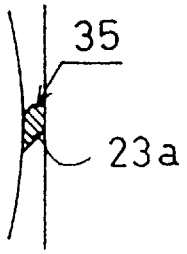

FIGS. 27*a* through 27*c* show a housing 9 of a blower in the eighth embodiment. An axial-flow fan 1 in the embodiment is the case with the fourth embodiment.

A housing 17 in the eighth embodiment slightly differs only in shape from that in the fifth embodiment. In FIGS. 27*a* through 27*c*, the spacers 20 in the fifth embodiment are spacers 23*a* and 23*b*.

As shown in FIGS. 27*a* through 27*c*, eight spacers are provided. Four of these spacers, or four spacers 23*a* in four base corners, are installed in the radial direction with respect to a boss while spacers 23*b* on four sides are installed at an angle of 45° to the radial direction. Six of the eight spacers are arranged in parallel to each other.

Figure 28A:
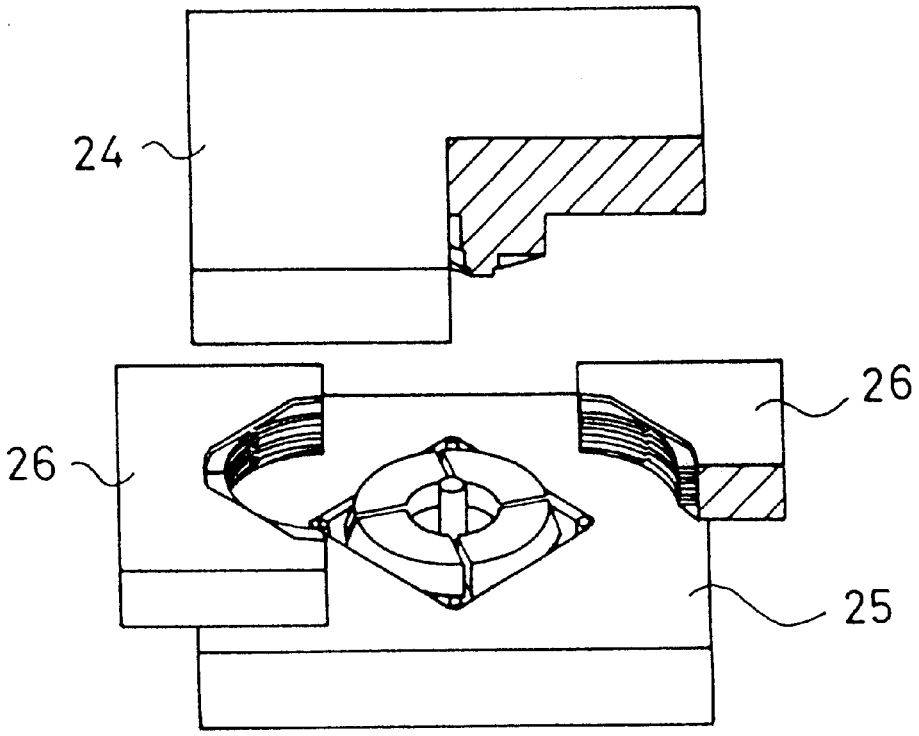
FIGS. 28*a* and 28*b* are a partially cross-sectional perspective view and a front view of a mold arrangement for the eighth embodiment, respectively.
Figure 28B:
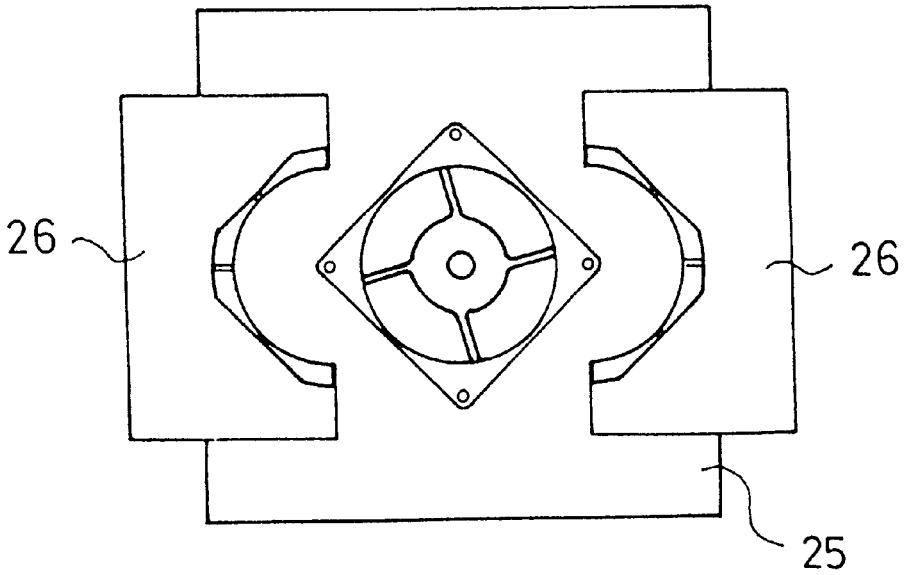
Figure 29A:
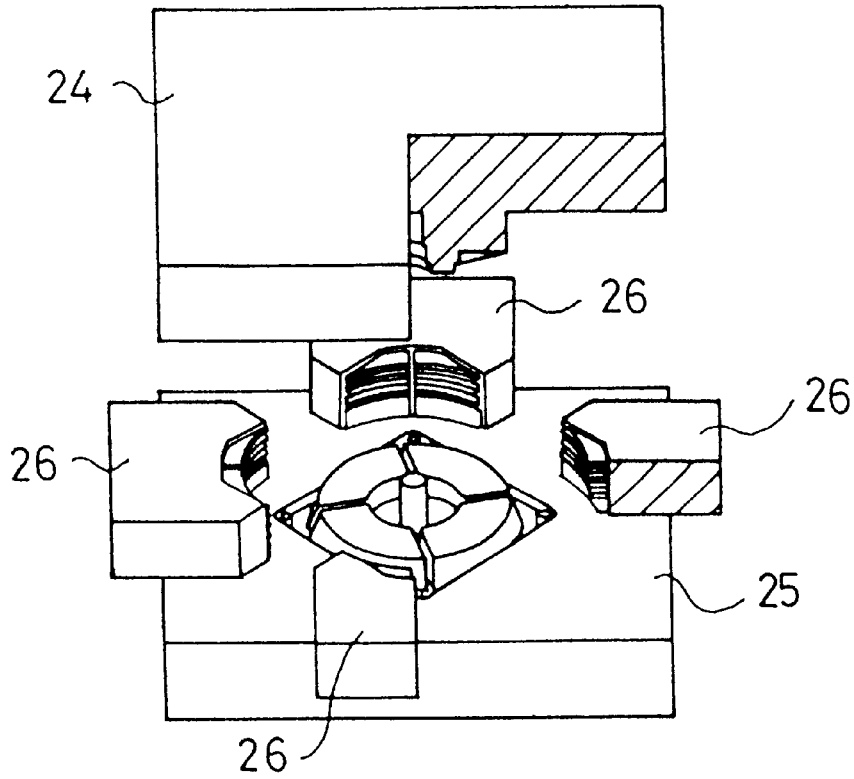
FIGS. 29*a* and 29*b* show the structure of a mold for molding a housing of the fifth embodiment, respectively.
Figure 29B:
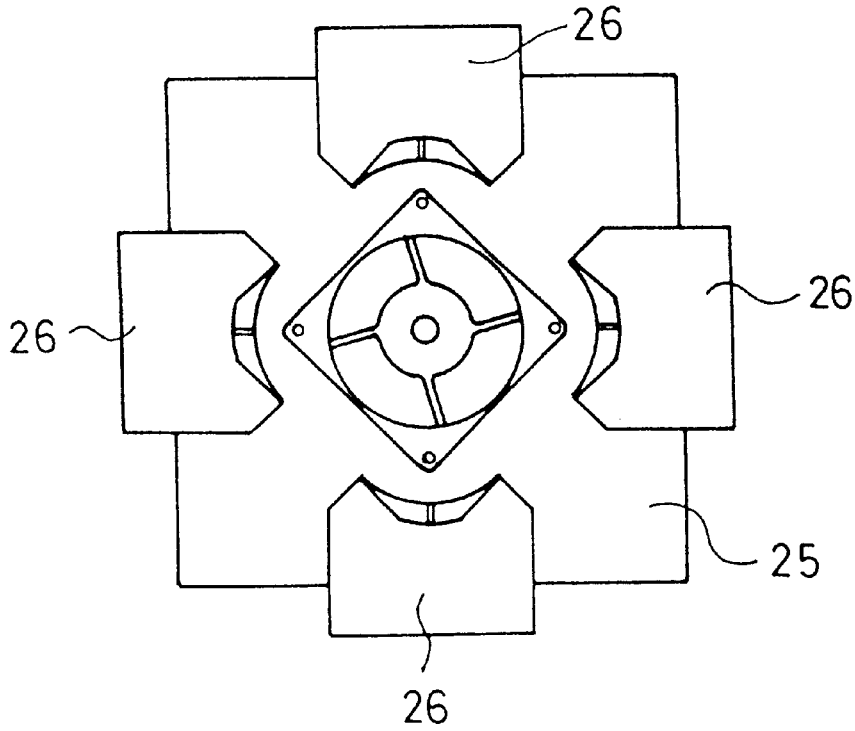

Disposing the spacers 23*a* and 23*b* in this way makes it possible to mold the housing 17 using a relatively simple arrangement of upper and lower molds 24 and 25 and two slide cores 26 shown in FIGS. 28*a* and 28*b*. This mold arrangement is a common means for molding a blower housing, whose geometry is suitable for mass production.

On the other hand, a mold arrangement for the fifth embodiment in which all spacers are disposed in the radial direction needs at least upper and lower molds 24, 25 and four slide cores 26 as shown in FIGS. 16*a* and 16*b*. For such a complicated mold arrangement, a mold cost itself is high. Moreover, molding equipment occupies a large space because of a large basic mold size, or the number of products molded using the same equipment is small. This reduces mass productivity and increases a housing production cost.

Since air flows in substantially in the radial direction from outside an annular wall when a blower is in operation, a spacer, if disposed to be inclined to the radial direction, blocks air flow, thus deteriorating blower performance. However, in the eighth embodiment, installing on the four sides, whose length in the radial direction is short, spacers which should be inclined allows the spacers to be short, so that the effect of the inclined spacers is minimized.

As denoted by a numeral 35 in FIG. 27*c*, when the outside of the spacers 23*a* on the four sides of the housing is chamfered, an increase in air flow resistance, a deterioration in the P-Q characteristic, and an increase in noise can be minimized.

Figure 30A:
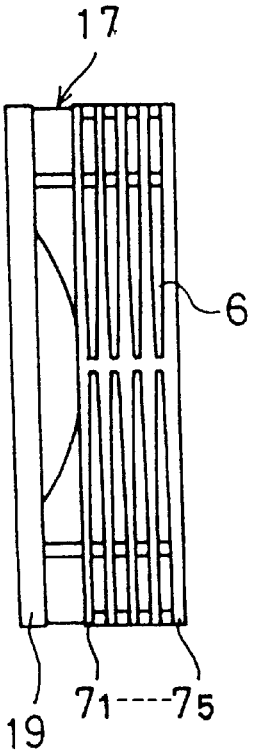
FIGS. 30*a* through 30*c* are a side view and a front view of a housing of a ninth embodiment and a detailed view of a spacer for the housing, respectively.
Figure 30B:
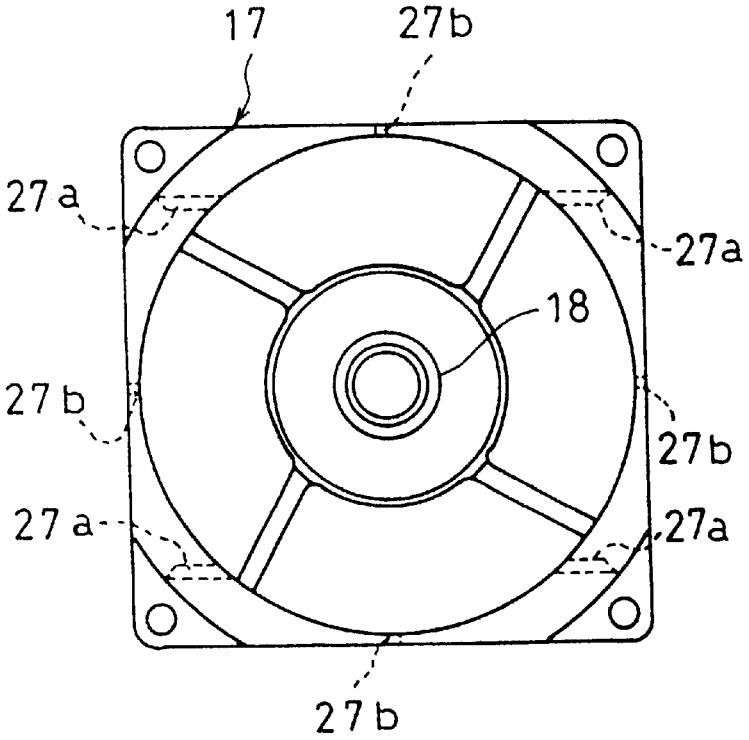
Figure 30C:
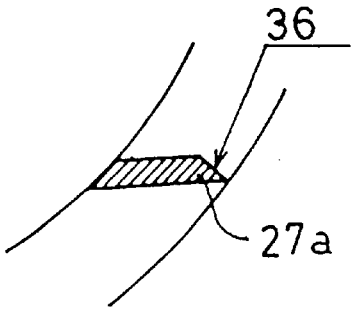

FIGS. 30*a* through 30*c* show a housing 17 for a blower of the ninth embodiment. An axial-flow fan 1 in the embodiment is the case with the fourth embodiment. The housing 17 in the ninth embodiment slightly differs only in spacer shape from that in the eighth embodiment. In FIGS. 30*a* through 30*c*, the spacers 23*a* and 23*b* in the eighth embodiment are spacers 27*a* and 27*b*.

Figure 31A:
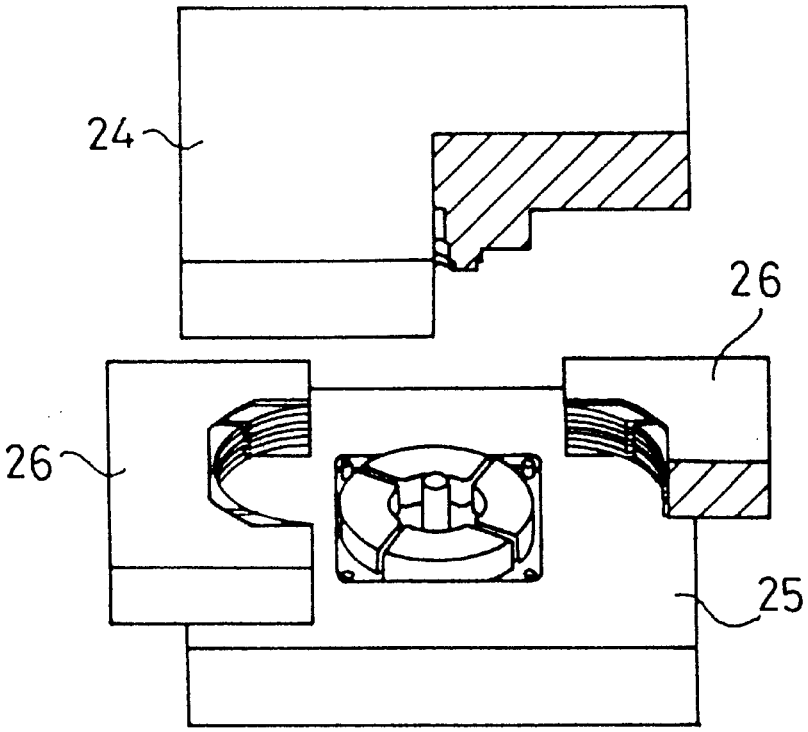
FIGS. 31*a* and 31*b* are a partially cross-sectional perspective view and a front view of a mold arrangement for the ninth embodiment, respectively.
Figure 31B:
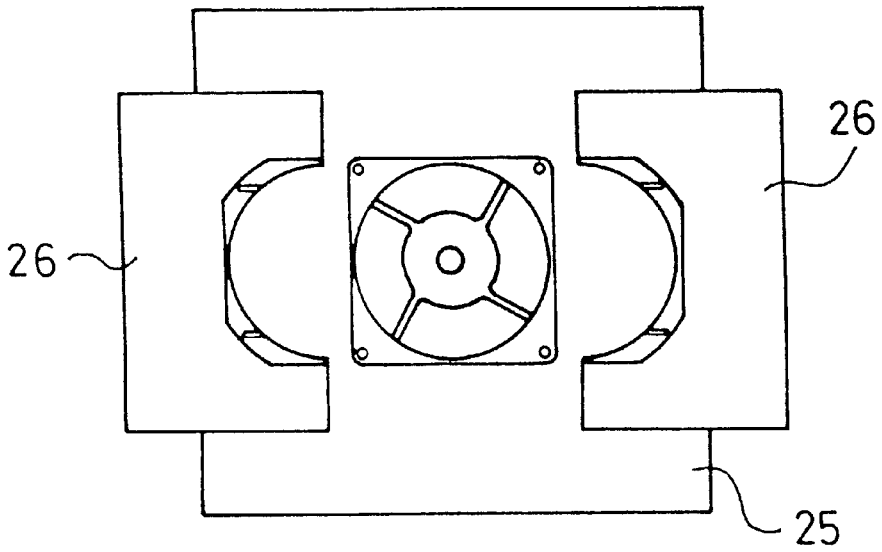

As shown in FIGS. 30*a* through 30*c*, eight spacers are provided, four spacers 27*a* in four corners being inclined to the radial direction. As is the case with the eighth embodiment, the housing can be molded using a relatively simple arrangement of upper and lower molds 24, 25 and two slide cores 26 as shown in FIGS. 31*a* and 31*b*.

For this embodiment, the slits 6 on the four sides can easily be reduced in width, thus keeping changes in flow resistance all around the annular wall relatively small, though the spacers 27*a* inclined to the radial direction are disposed in a rectangle with a large radial length, thus blocking air flow. This means that a housing can be provided which is comparable in comprehensive performance and cost to the housing 17 of the eighth embodiment.

As shown in FIG. 30*c*, when the outside of the spacers 27*a* in the four corners of the housing 17 is cut obliquely as shown 36, an increase in air flow resistance, a deterioration in the P-Q characteristic, and an increase in noise can be minimized.

The eighth and ninth embodiments have been described using two examples of a shape of housing. Disposing (n-2) of n spacers (n is an integer equal to or larger than five) in parallel with each other makes it possible to mold a housing, using a relatively simple arrangement of upper and lower molds 24, 25 and two slide cores 26. This enables a housing offering high mass productivity whose production cost is reduced to be provided, thus resulting in a high cost-per-performance blower.

In the above description of the embodiments, an axial-flow fan has been used as an example, but the same holds true of an oblique-flow fan. Also in the description, resin injection molding has been taken as an example, but the same mold arrangement can apply to die casting.

In the above embodiments, a combination of a fan, wherein a cross section obtained by cutting a blade through the surface of a cylinder concentric with the rotational axis of a fan provides an airfoil, and the blade end is formed into an airfoil with respect to incoming air flow through slits, and a housing provides a blower, but a combination of a housing in each embodiment and a fan having a conventional shape is expected to offer an improvement, though the combination is inferior to the preferred embodiments.

As described above, according to the present invention, an annular wall is formed away from the ends of fan blades, slits passing from the inner circumference of the annular wall to its outer circumference are further formed at locations facing the blade ends in the annular wall, and the width of the slits are continuously changed to make constant the flow rate of air flowing inside the annular wall through the slits all around the annular wall. This arrangement improves air blowing condition and restricts blade vibration and disk circulation by inhibiting air flow separation and vortices on the back pressure side of the fan. Thus the P-Q characteristic is improved and noise is reduced, compared with a conventional blower. In addition, changing the width of the slits w and the number of slits n at the same time to make constant the flow rate of air flowing inside the annular wall through the slits all around the annular wall increases the effect of improving the P-Q characteristic and reducing noise. Moreover, spacers, forming and supporting the slits, can be disposed near the middle of the four sides of a casing body to bear the annular plates and reinforce weak sections of the annular plates. Projecting the spacers near the middle of the four sides of the casing body outward from the annular wall can prevent the annular plates from being damaged and deforming under an undue load when they are installed. Tapering the projected sections of the spacers along the direction of the axis of rotation provides practically enough strength and increases the workability when a blower is installed, thus facilitating replacement of a conventional blower.

As described in each of the claims, an apparatus according to the present invention is a blower that sucks air inside an annular wall through slits provided in the annular wall, wherein the shape of a blade of a fan, that of a housing, or both are improved. The blower can cut production cost by increasing aerodynamic performance, strength, or mass productivity.

A housing molding method according to the present invention enables slits to be made all around an annular wall at a time using upper and lower molds, forming the inner surface of the annular wall and a boss, and a pair of slide cores, vertically sliding opposite to the upper and lower molds. Thus forming into one piece the annular wall having the slits, a base providing a reference for blower installation, and the boss to which a motor is secured, enables housing mass productivity to increase and cost to be reduced.

We claim:

1. A blower which sucks air inside an annular wall through slits as a fan rotates, the annular wall being formed away from the ends of fan blades, and the slits, passing from a circular inner perimeter to a non-circular outer perimeter of the annular wall, being formed in sections of the annular wall which are opposite to the ends of the fan blades, wherein said slits are formed to have a shape which allows the flow rate of air flowing inside the annular wall through said slits to be constant all around the annular wall.

2. A blower which sucks air inside an annular wall through slits as a fan rotates, the annular wall being formed away from the ends of fan blades, and the slits, passing from a circular inner perimeter to a non-circular outer perimeter of the annular wall, being formed in sections of the annular wall which are opposite to the ends of the fan blades, wherein the flow rate of air flowing inside the annular wall through the slits is made constant all around the annular wall by continuously or intermittently changing the width of said slits, w, according to the radial length between the inner and outer perimeters of the annular wall, L, so that the condition represented by the following equation is met:

$$w^3/L=\text{constant}.$$

3. A blower according to claim 2, wherein a plurality of annular plates are spaced from each other and stacked in the direction of the axis of rotation of the fan to form the annular wall with slits.

4. A blower which sucks air inside an annular wall through slits as a fan rotates, the annular wall being formed away from the ends of fan blades, and the slits, passing from a circular inner perimeter to a non-circular outer perimeter of the annular wall, being formed in sections of the annular wall which are opposite to said ends of the fan blades, wherein the flow rate of air flowing inside the annular wall through the slits is made constant all around the annular wall by changing the width of said slits, w, and the number of slits in the direction of the axis of rotation, n, where n is a positive integer, according to the radial length between the inner and outer perimeters of the annular wall, L, so that the condition represented by the following equation is met:

$$n \cdot w^3/L=\text{constant}.$$

5. A blower which is arranged to suck air inside an annular wall through slits as a fan rotates, the annular wall being formed away from the ends of fan blades, and the slits, passing from the inner perimeter to the outer perimeter of the annular wall at a section which corresponds to the ends of the fan blades, being formed in sections of the annular wall which are opposite to said ends of the fan blades, wherein the annular wall with the slits is formed by stacking a plurality of annular plates in a spaced relation from each other through spacers in the direction of the axis of rotation of the fan, and the annular plate that is located at the most upstream side of the main air flow produced by the fan rotation has the largest thickness among all the annular plates.

6. A blower which is arranged to suck air inside an annular wall through slits as a fan rotates, the annular wall being formed away from the ends of fan blades, and the slits, passing from the inner perimeter to the outer perimeter of the annular wall at a section which corresponds to the ends of the fan blades, being formed in sections of the annular wall which are opposite to said ends of the fan blades, wherein the annular wall with the slits is formed by stacking a plurality of annular plates in a spaced relation from each other through spacers in the direction of the axis of rotation of the fan, and the annular plate that is located at the most upstream side of the main air flow produced by the fan rotation has the largest thickness among all the annular plates, and wherein the annular plate that is located at the most upstream side of the main air flow produced by the fan rotation is formed by cutting the upstream-side end surface of the inner perimeter so that the perimeter becomes thin.

7. A blower which is arranged to suck air inside an annular wall through slits as a fan rotates, the annular wall being formed away from the ends of fan blades, and the slits, passing from the inner perimeter to the outer perimeter of the annular wall at a section which corresponds to the ends of the fan blades, being formed in sections of the annular wall which are opposite to said ends of fan blades, wherein the clearance between the end of a fan blade and the inner perimeter of the annular wall becomes wider as it gets farther away from a bearing support.

* * * * *